US010395573B2

(12) United States Patent
Ooki et al.

(10) Patent No.: US 10,395,573 B2
(45) Date of Patent: Aug. 27, 2019

(54) DISPLAY APPARATUS

(71) Applicant: Japan Display Inc., Tokyo (JP)

(72) Inventors: Youichi Ooki, Tokyo (JP); Hiroki Uchiyama, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 15/464,624

(22) Filed: Mar. 21, 2017

(65) Prior Publication Data

US 2017/0278441 A1 Sep. 28, 2017

(30) Foreign Application Priority Data

Mar. 28, 2016 (JP) ..... 2016-064289

(51) Int. Cl.
*G09G 3/00* (2006.01)
*G09G 3/36* (2006.01)

(52) U.S. Cl.
CPC ..... *G09G 3/006* (2013.01); *G09G 3/3648* (2013.01); *G09G 3/3677* (2013.01); *G09G 2330/12* (2013.01)

(58) Field of Classification Search
None
See application file for complete search history.

(56) References Cited

U.S. PATENT DOCUMENTS 5,515,390 A * 5/1996 Benton ..... G06F 11/0754 324/73.1
5,652,632 A * 7/1997 Shimizu ..... G02F 1/136204 349/40
5,963,249 A * 10/1999 Kim ..... H04N 17/045 348/178
6,246,178 B1 * 6/2001 Isono ..... G09G 3/22 313/336
6,566,902 B2 * 5/2003 Kwon ..... G02F 1/136204 324/750.3
6,614,053 B1 * 9/2003 Takenaka ..... H01L 27/14687 257/66
7,417,215 B2 * 8/2008 Choi ..... G09G 3/006 250/205
7,919,975 B2 * 4/2011 Ryu ..... G09G 3/006 324/760.01
7,995,011 B2 * 8/2011 Jeong ..... G09G 3/006 315/169.3

(Continued)

FOREIGN PATENT DOCUMENTS

JP 05-346587 A 12/1993
JP 2010-104141 A 5/2010

(Continued)

OTHER PUBLICATIONS

Japanese Office Action dated May 14, 2019, corresponding to Japanese Patent Application No. 2016-064289.

*Primary Examiner* — Patrick Assouad
*Assistant Examiner* — Demetrius R Pretlow
(74) *Attorney, Agent, or Firm* — Michael Best & Friedrich LLP

(57) ABSTRACT

According to an aspect, a display apparatus includes: a signal line or a scanning line coupled to a plurality of pixels arranged in a display region; a driver that supplies a drive signal via a resistor to the signal line or the scanning line; and an anomaly detector that monitors a response characteristic of a node between the resistor and the signal line or a node between the resistor and the scanning line.

14 Claims, 18 Drawing Sheets

(56) References Cited

U.S. PATENT DOCUMENTS 8,115,505 B2 * 2/2012 Ryu ..... G09G 3/006 324/629
8,742,784 B2 * 6/2014 Kim ..... G09G 3/006 324/750.3
2002/0063662 A1 * 5/2002 Nagakubo ..... G09G 3/2022 345/60
2004/0222814 A1 * 11/2004 Kim ..... G09G 3/006 324/760.01
2005/0270059 A1 * 12/2005 Ando ..... G09G 3/006 324/760.01
2009/0273279 A1 * 11/2009 Chino ..... H01L 51/5228 313/504
2011/0057966 A1 * 3/2011 Ono ..... G09G 3/3233 345/690
2011/0074664 A1 * 3/2011 Lebrun ..... G09G 3/006 345/98
2011/0121904 A1 5/2011 Kojima
2011/0234574 A1 9/2011 Tanaka et al.
2012/0306826 A1 * 12/2012 Tsuchi ..... G09G 3/006 345/204
2013/0342229 A1 12/2013 Wang
2015/0061723 A1 * 3/2015 Zhang ..... G09G 3/006 324/762.01
2015/0138172 A1 * 5/2015 Kim ..... G09G 3/20 345/205
2016/0098958 A1 * 4/2016 Kang ..... G09G 3/3208 345/78
2016/0148549 A1 * 5/2016 Okumoto ..... G09G 3/006 324/760.02
2016/0189581 A1 * 6/2016 Hwang ..... G09G 3/006 345/691
2017/0255504 A1 * 9/2017 Fletcher ..... G09G 3/006
2018/0005556 A1 * 1/2018 Xu ..... G09G 3/006

FOREIGN PATENT DOCUMENTS

JP 2010-107933 A 5/2010
JP 2010-110068 A 5/2010
JP 2011-00448 A 1/2011
JP 2011-129833 A 6/2011
JP 2012-205477 A 10/2012
WO 2010/140190 A1 12/2010

* cited by examiner

FIG.8

| Y-COORDINATE \ X-COORDINATE | | 1 | 2 | 3 | ··· | a-2 | a-1 | a | a+1 | a+2 | a+3 | ··· | m-2 | m-1 | m |
|---|---|---|---|---|---|---|---|---|---|---|---|---|---|---|---|
| | DetG(Y) \ DetS(X) | 0 | 0 | 0 | ··· | 0 | 0 | 1 | 0 | 0 | 0 | ··· | 0 | 0 | 0 |
| 1 | 0 | | | | | | | | | | | | | | |
| 2 | 0 | | | | | | | | | | | | | | |
| 3 | 0 | | | | | | | | | | | | | | |
| 4 | 0 | | | | | | | | | | | | | | |
| 5 | 0 | | | | | | | | | | | | | | |
| ⋮ | ⋮ | | | | | | | | | | | | | | |
| b-3 | 0 | | | | | | | | | | | | | | |
| b-2 | 0 | | | | | | | | | | | | | | |
| b-1 | 0 | | | | | | | | | | | | | | |
| b | 1 | | | | | | | (a, b) | | | | | | | |
| b+1 | 0 | | | | | | | | | | | | | | |
| b+2 | 0 | | | | | | | | | | | | | | |
| b+3 | 0 | | | | | | | | | | | | | | |
| b+4 | 0 | | | | | | | | | | | | | | |
| ⋮ | ⋮ | | | | | | | | | | | | | | |
| n-2 | 0 | | | | | | | | | | | | | | |
| n-1 | 0 | | | | | | | | | | | | | | |
| n | 0 | | | | | | | | | | | | | | |

DISPLAY APPARATUS

CROSS-REFERENCE TO RELATED APPLICATIONS

This application claims priority from Japanese Application No. 2016-064289, filed on Mar. 28, 2016, the contents of which are incorporated by reference herein in its entirety.

BACKGROUND

1. Technical Field

The present invention relates to a display apparatus.

2. Description of the Related Art

In recent years, as an on-vehicle display apparatus such as a car navigation system, widely used is a flat-display type display apparatus including a liquid crystal panel and the like. Such a flat-display type display apparatus can be considered to be used as an on-vehicle display apparatus including a camera mounted on a vehicle body to display an image of the outside of the vehicle for assisting driving of a driver.

Damage in a display region of a display panel such as a liquid crystal display apparatus may cause abnormal heating in a display panel main body, a driver IC for driving the display panel, and the like. To analyze a failure in the display panel, typically, external appearance needs to be checked using a microscope and the like or a computer program for detecting electrical damage needs to be used for performing analysis, so that time and labor are required for specifying a failure spot and a cause of the failure. Japanese Patent Application Laid-open Publication No. 5-346587 discloses a technique of electrically detecting damage in a liquid crystal display element by providing a crack detection electrode in a first portion of a transparent substrate other than a second portion thereof, and performing a conduction test of the crack detection electrode. The transparent substrate is a substrate on which a liquid crystal display element is provided, and the second portion is a portion in which a display electrode is provided.

In the related art described above, the crack detection electrode needs to be additionally provided in the display panel.

For the foregoing reasons, there is a need for a display apparatus that can detect deterioration in a display region.

SUMMARY

According to an aspect, a display apparatus includes: a signal line or a scanning line coupled to a plurality of pixels arranged in a display region; a driver that supplies a drive signal via a resistor to the signal line or the scanning line; and an anomaly detector that monitors a response characteristic of a node between the resistor and the signal line or a node between the resistor and the scanning line.

BRIEF DESCRIPTION OF THE DRAWINGS

FIG. 8 is a diagram illustrating an example of each source signal determination result and each gate signal determination result stored in the determination result storage unit;

DETAILED DESCRIPTION

Figure 1:
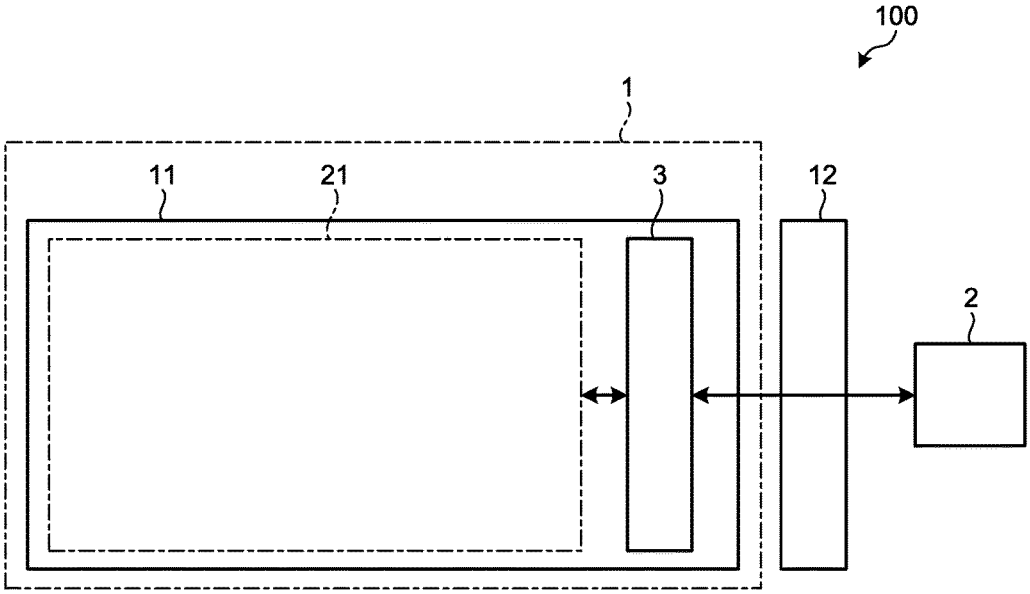
FIG. 1 is a diagram illustrating an example of a schematic configuration of a display system to which a display apparatus according to a first embodiment is applied.

The following describes a mode for carrying out the invention in detail with reference to the drawings. The present invention is not limited to the embodiments described below. Components described below include a component that is easily conceivable by those skilled in the art and components that are substantially the same. The components described below can be appropriately combined. The disclosure is merely an example, and the present invention naturally encompasses an appropriate modification maintaining the gist of the invention that is easily conceivable by those skilled in the art. To further clarify the description, the width, the thickness, the shape, and the like of each component may be schematically illustrated in the drawings as compared with an actual aspect. However, the drawings merely provide examples, and are not intended to limit interpretation of the invention. The same element as that described in the drawing already discussed is denoted by the same reference numeral throughout the description and the drawings, and detailed description thereof will not be repeated in some cases.

In this disclosure, when an element is described as being "on" another element, the element can be directly on the other element, or there can be one or more elements between the element and the other element.

First Embodiment

FIG. 1 is a diagram illustrating an example of a schematic configuration of a display system to which a display apparatus according to a first embodiment is applied. A display system 100 according to the present embodiment includes a display apparatus 1 and a control apparatus 2.

The display system 100 is configured such that the display apparatus 1 includes a display region 21 and a driver IC 3 on a glass substrate 11, and the driver IC 3 is coupled to the control apparatus 2 via a relay substrate 12 including a flexible printed circuit (FPC), for example. In the present embodiment, the display apparatus 1 is, for example, an active matrix type liquid crystal display device including an amorphous silicon (a-Si) thin film transistor (TFT) or a low-temperature polysilicon (LIPS) TFT.

The control apparatus 2 includes, for example, a central processing unit (CPU) and a storage device such as a memory, and can implement various functions in the display apparatus 1 by executing a computer program using such hardware resources. The control apparatus 2 controls the driver IC 3 to be able to handle an image to be displayed by the display apparatus 1 as image input gradation information in accordance with an execution result of the computer program. The control apparatus 2 has a function of performing predetermined processing in a case in which a display operation of the display apparatus 1 is not normal, that is, the display operation of the liquid crystal display apparatus 1 is abnormal.

Figure 2:
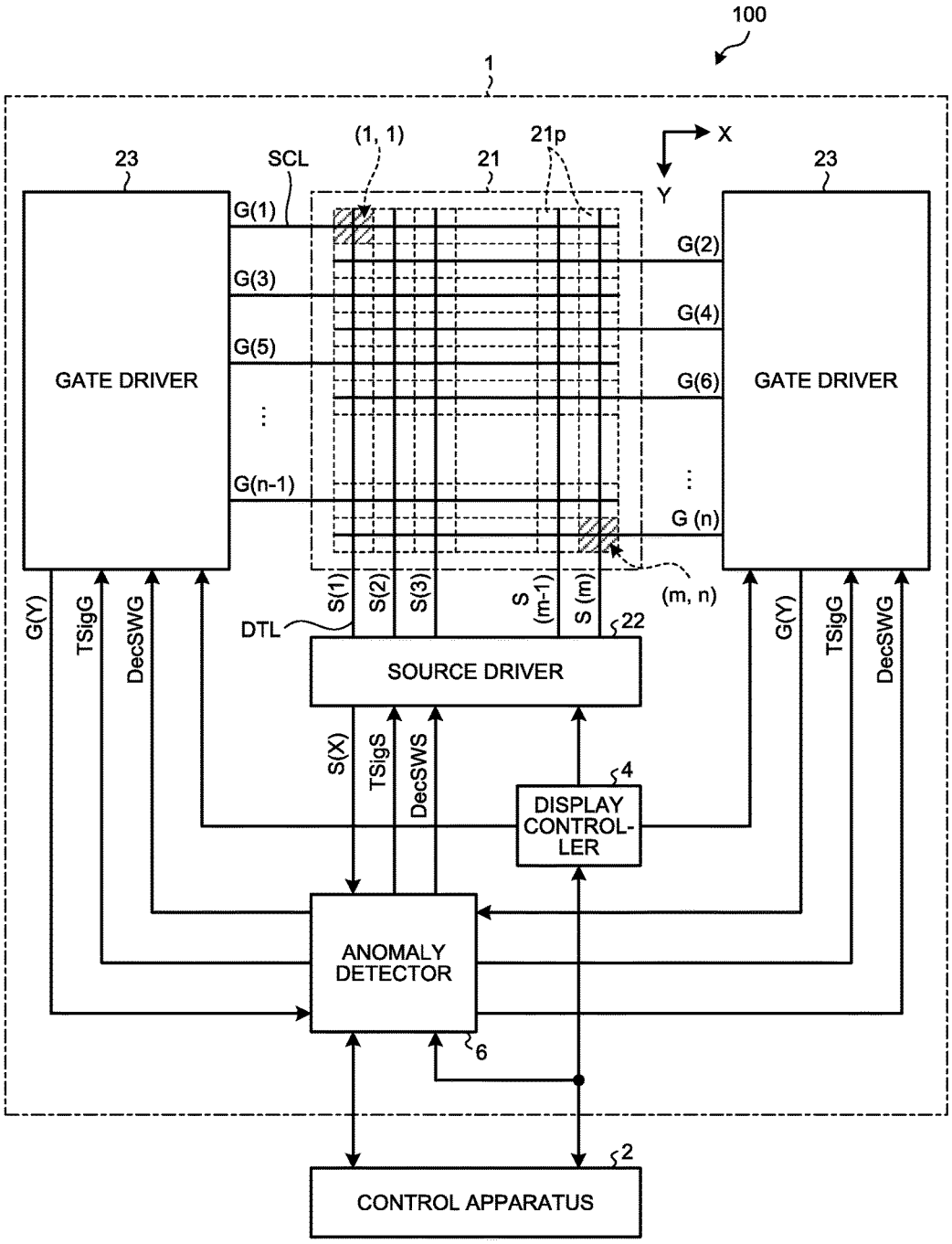
FIG. 2 is a block diagram illustrating an example of the display apparatus according to the first embodiment.

FIG. 2 is a block diagram illustrating an example of the display apparatus according to the first embodiment. The display apparatus 1 according to the present embodiment includes the display region 21, a source driver (first driver) 22, a gate driver (second driver) 23, a display controller 4, and an anomaly detector 6 that performs an anomaly detection operation described later. The source driver 22, the gate driver 23, the display controller 4, and the anomaly detector 6 are included in the driver IC 3 illustrated in FIG. 1, but the embodiment is not limited thereto. At least part of the functions of these components may be implemented by another component formed on the glass substrate 11, or formed on another IC.

In the display region 21, pixels 21*p* (m pixels in the X-direction, and n pixels in the Y-direction) illustrated in FIG. 2 are arranged in a matrix (rows and columns). In this description, the row indicates a pixel row including m pixels 21*p* arranged in a first direction. The column indicates a pixel column including n pixels 21*p* arranged in a second direction orthogonal to or intersecting with the first direction. Values of n and m are determined depending on display resolution in a vertical direction and display resolution in a horizontal direction. Hereinafter, coordinates of the pixel 21*p* arranged in the first column in the X-direction and in the first row in the Y-direction are represented as (1, 1), and the coordinates of the pixel 21*p* arranged in the m-th column in the X-direction and in the n-th row in the Y-direction are represented as (m, n).

In the display apparatus 1 according to the present embodiment, each pixel 21*p* includes a TFT element and a liquid crystal element that are not illustrated. In each pixel 21*p*, an electrostatic capacitive element is formed in parallel with the liquid crystal element.

In the display region 21, for an m-columns×n-rows arrangement of the pixels 21*p*, a source signal line (signal line) DTL is arranged for each column and a gate signal line (scanning line) SCL is arranged for each row. A source drive signal (first drive signal) S(X) (X is 1, 2, . . . , m) is supplied to each source signal line (signal line) DTL from the source driver 22. A gate drive signal (second drive signal) G(Y) (Y is 1, 2, . . . , n) is supplied to each gate signal line (scanning line) SCL from the gate driver 23. The source drive signal S(X) is supplied to a pixel electrode via a source or a drain of the TFT element included in each pixel 21*p*. The gate drive signal G(Y) is supplied to a gate of the TFT element included in each pixel 21*p*.

The display controller 4 has a function of a timing generator and an interface (I/F) between the control apparatus 2 and each of the source driver 22 and the gate driver 23 required for displaying an image in the display region 21. A detailed operation in the display controller 4 is not described herein.

In the present embodiment, the anomaly detector 6 performs the anomaly detection operation for detecting damage, deterioration, and the like in the display region 21 at the time of activation of the display system 100 or in a non-display period such as a vertical blanking period (vertical retrace period) in the display apparatus 1.

The source drive signal S(X) output from the source driver 22 is input to the anomaly detector 6.

The gate drive signal G(Y) output from the gate driver 23 is also input to the anomaly detector 6.

The anomaly detector 6 starts to perform the anomaly detection operation in response to various signals from the control apparatus 2 or the display controller 4. At this point, the anomaly detector 6 outputs a source signal line anomaly detection operation start signal DecSWS to the source driver 22, and outputs a gate signal line anomaly detection operation start signal DecSWG to the gate driver 23. The anomaly detector 6 supplies a source signal for testing TSigS to the source driver 22, and supplies a gate signal for testing TSigG to the gate driver 23. A start timing of the anomaly detection operation will be described later.

Figure 3A:
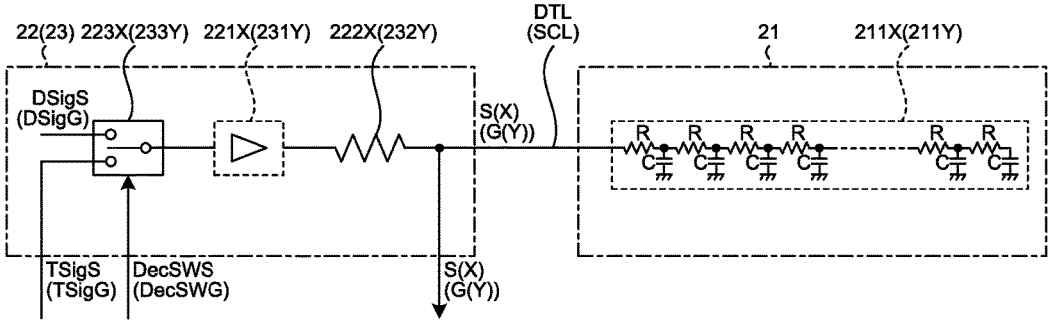
FIGS. 3A to 3C are diagrams illustrating a configuration example of an output stage of a source driver and a gate driver, and an equivalent circuit for each pixel column or each pixel row in a display region.
Figure 3B:
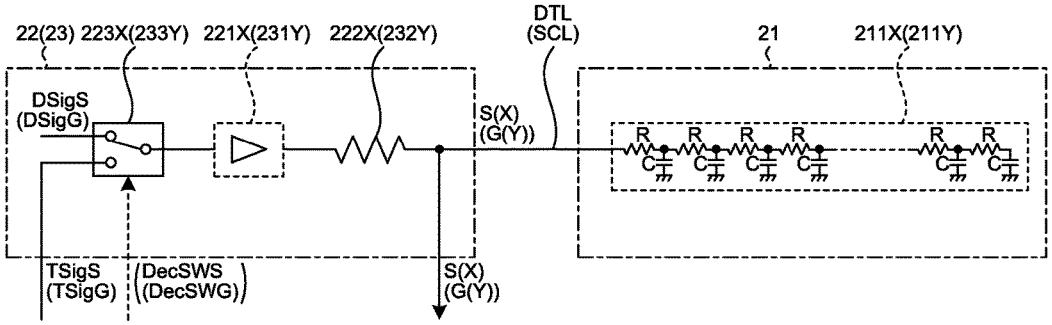
Figure 3C:
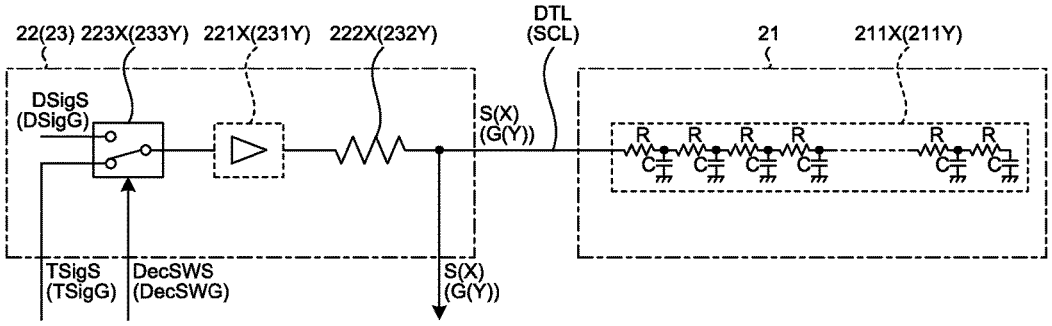

FIGS. 3A to 3C are diagrams illustrating a configuration example of an output stage of the source driver and the gate driver, and an equivalent circuit for each pixel column or each pixel row in the display region. As illustrated in FIGS. 3A to 3C, each source signal line (signal line) DTL and each gate signal line (scanning line) SCL in the display region 21 are represented as an equivalent circuit in which time constant circuits are coupled in series, the time constant circuit constituted of a resistance component R of about several Ω including resistance in wiring and the like, and an electrostatic capacitance component C including gate capacitance, other parasitic capacitance, and the like. Hereinafter, in the display region 21, an equivalent circuit for each of the pixel columns that correspond to the respective source signal lines (signal lines) DTL is referred to as a "source signal line equivalent circuit 211X", and an equivalent circuit for each of the pixel rows that correspond to the respective gate signal lines (scanning lines) SCL is referred to as a "gate signal line equivalent circuit 211Y". The present invention is not limited by a size of the resistance component R or the electrostatic capacitance component C included in the time constant circuit. For example, a resistance element or an electrostatic capacitive element may be additionally provided in each source signal line (signal line) DTL and each gate signal line (scanning line) SCL.

As illustrated in FIG. 3A, the source driver 22 includes the source signal drive circuit 221X, a source signal output resistor 222X, and a source signal selector switch 223X. The gate driver 23 includes a gate signal drive circuit 231Y, a gate signal output resistor 232Y, and a gate signal selector switch 233Y. The source signal drive circuit 221X and the gate signal drive circuit 231Y are constituted of an amplifier or an output driver, for example.

In a normal condition in which an image is displayed in the display region 21, as illustrated in FIG. 3B, a source signal for image display DSigS (gate signal for image display DSigG) is selected by the source signal selector switch 223X (gate signal selector switch 233Y).

When the source signal line anomaly detection operation start signal DecSWS (gate signal line anomaly detection operation start signal DecSWG) is output from the anomaly detector 6, as illustrated in FIG. 3C, the source signal for testing TSigS (gate signal for testing TSigG) is selected by the source signal selector switch 223X (gate signal selector switch 233Y).

The source signal drive circuit 221X amplifies an output from the source signal selector switch 223X.

The source signal output resistor 222X is a resistor for protecting an element (for example, about several kΩ) and provided at an output end of the source driver 22.

The source drive signal S(X) output by the source signal drive circuit 221X is output to the source signal line equivalent circuit 211X via the source signal output resistor 222X.

The gate signal drive circuit 231Y amplifies an output from the gate signal selector switch 233Y.

The gate signal output resistor 232Y is a resistor for protecting an element (for example, about several kΩ) and provided at an output end of the gate driver 23.

The gate drive signal G(Y) output by the gate signal drive circuit 231Y is output to the gate signal line equivalent circuit 211Y via the gate signal output resistor 232Y.

Figure 4:
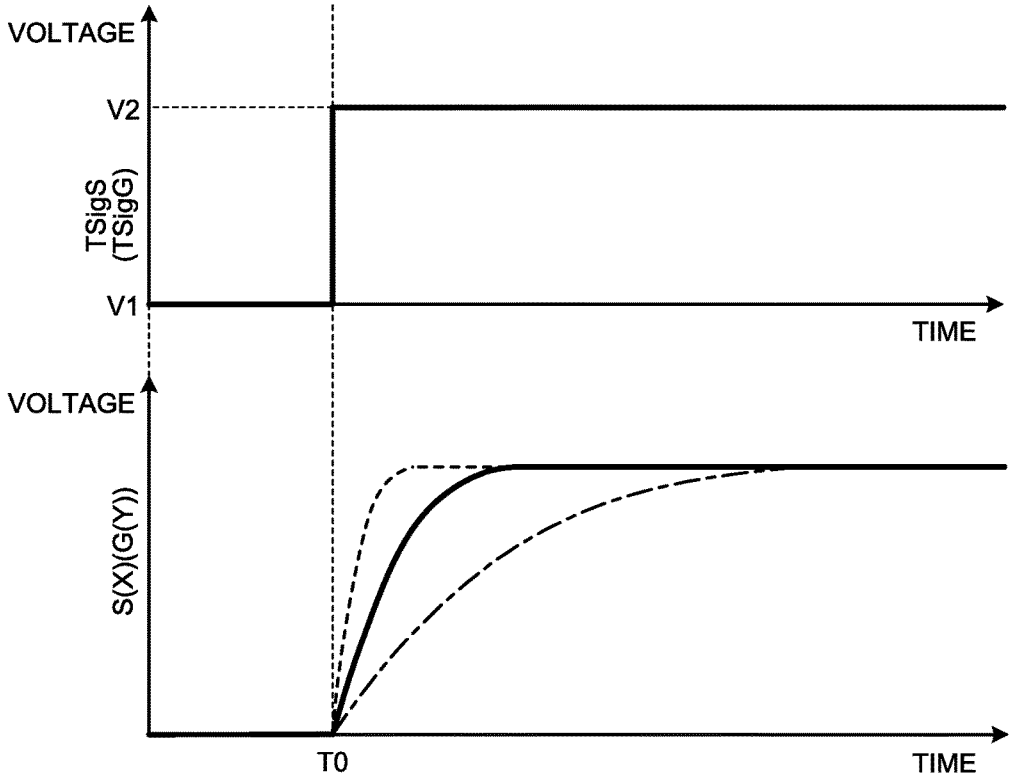
FIG. 4 is a diagram illustrating a relation between a source signal for testing and a gate signal for testing, and a source drive signal and a gate drive signal at the time when the display apparatus according to the first embodiment performs anomaly detection operation.

FIG. 4 is a diagram illustrating a relation between the source signal for testing and the gate signal for testing, and the source drive signal and the gate drive signal at the time when the display apparatus according to the first embodiment performs the anomaly detection operation. In the present embodiment, each of the source signal for testing TSigS and the gate signal for testing TSigG is assumed to be a voltage signal having a stepped waveform that is changed from a first potential V1 to a second potential V2 different from the first potential V1 at predetermined time T0. In the example illustrated in FIG. 4, a voltage signal having a stepped waveform that is changed from the first potential V1 to the second potential V2 higher than the first potential V1 at the predetermined time T0 is assumed to be each of the source signal for testing TSigS and the gate signal for testing TSigG.

When the source signal for testing TSigS (gate signal for testing TSigG) described above is input, the source drive signal S(X) (gate drive signal G(Y)) corresponding to the source signal for testing TSigS (gate signal for testing TSigG) is generated. In the present embodiment, as described above, the voltage signal having a stepped waveform that is changed from the first potential V1 to the second potential V2 higher than the first potential V1 at the predetermined time T0 is input as the source signal for testing TSigS (gate signal for testing TSigG). As illustrated in FIG. 4, in contrast to the source signal for testing TSigS (gate signal for testing TSigG) having a stepped waveform described above, the source drive signal S(X) (gate drive signal G(Y)) has a response characteristic of being transitionally changed in accordance with a time constant of the source signal line equivalent circuit 211X (gate signal line equivalent circuit 211Y).

The anomaly detector 6 according to the present embodiment monitors the source drive signal S(X) (gate drive signal G(Y)) output via the resistor for protecting an element and performs the anomaly detection operation for detecting damage, deterioration, and the like in the display region 21 based on a change in the response characteristic of the source drive signal S(X) (gate drive signal G(Y)), the resistor being provided at the output end of the source driver 22 (gate driver 23).

The following describes a change factor of the response characteristic of the source drive signal S(X) (gate drive signal G(Y)).

In the example illustrated in FIG. 4, a solid line indicates the response characteristic of the source drive signal S(X) (gate drive signal G(Y)) in a normal condition in which the source signal line (signal line) DTL (gate signal line (scanning line) SCL) is not broken or the element included in the display region 21 is not deteriorated.

For example, if the source signal line (signal line) DTL (gate signal line (scanning line) SCL) is broken due to damage in the display region 21, a time constant of the source signal line equivalent circuit 211X (gate signal line equivalent circuit 211Y) is reduced due to a defect and the like in the electrostatic capacitance component C at a later stage than a broken part, and, as indicated by a dashed line in FIG. 4, the response characteristic of the source drive signal S(X) (gate drive signal G(Y)) rises more steeply than the response characteristic in the normal condition.

For example, if the element included in the display region 21 is deteriorated, the time constant of the source signal line equivalent circuit 211X (gate signal line equivalent circuit 211Y) is increased due to an increase and the like in the electrostatic capacitance component C, and, as indicated by an alternate long and short dash line in FIG. 4, the response characteristic of the source drive signal S(X) (gate drive signal G(Y)) rises more gently than the response characteristic in the normal condition. Examples of deterioration in the element included in the display region 21 include, but are not limited to, corrosion of the source signal line DTL (signal line SCL), an increase in wiring resistance due to electromigration and the like, an increase or decrease in gate capacitance due to deterioration in the TFT element, and an increase or decrease in parasitic resistance due to deterioration in the other parasitic capacitance.

That is, damage, deterioration, and the like in the display region 21 can be detected by detecting a change in the response characteristic of the source drive signal S(X) (gate drive signal G(Y)) caused by the change in the time constant of the source signal line equivalent circuit 211X (gate signal line equivalent circuit 211Y).

As described above, the present embodiment describes an example in which the source signal for testing TSigS (gate signal for testing TSigG) is the voltage signal having a stepped waveform that is changed from the first potential V1 to the second potential V2 different from the first potential V1 at the predetermined time T0. However, the source signal for testing TSigS (gate signal for testing TSigG) is not limited thereto so long as a pattern that can detect a change in the response characteristic of the source drive signal S(X) (gate drive signal G(Y)) is used.

Figure 5:
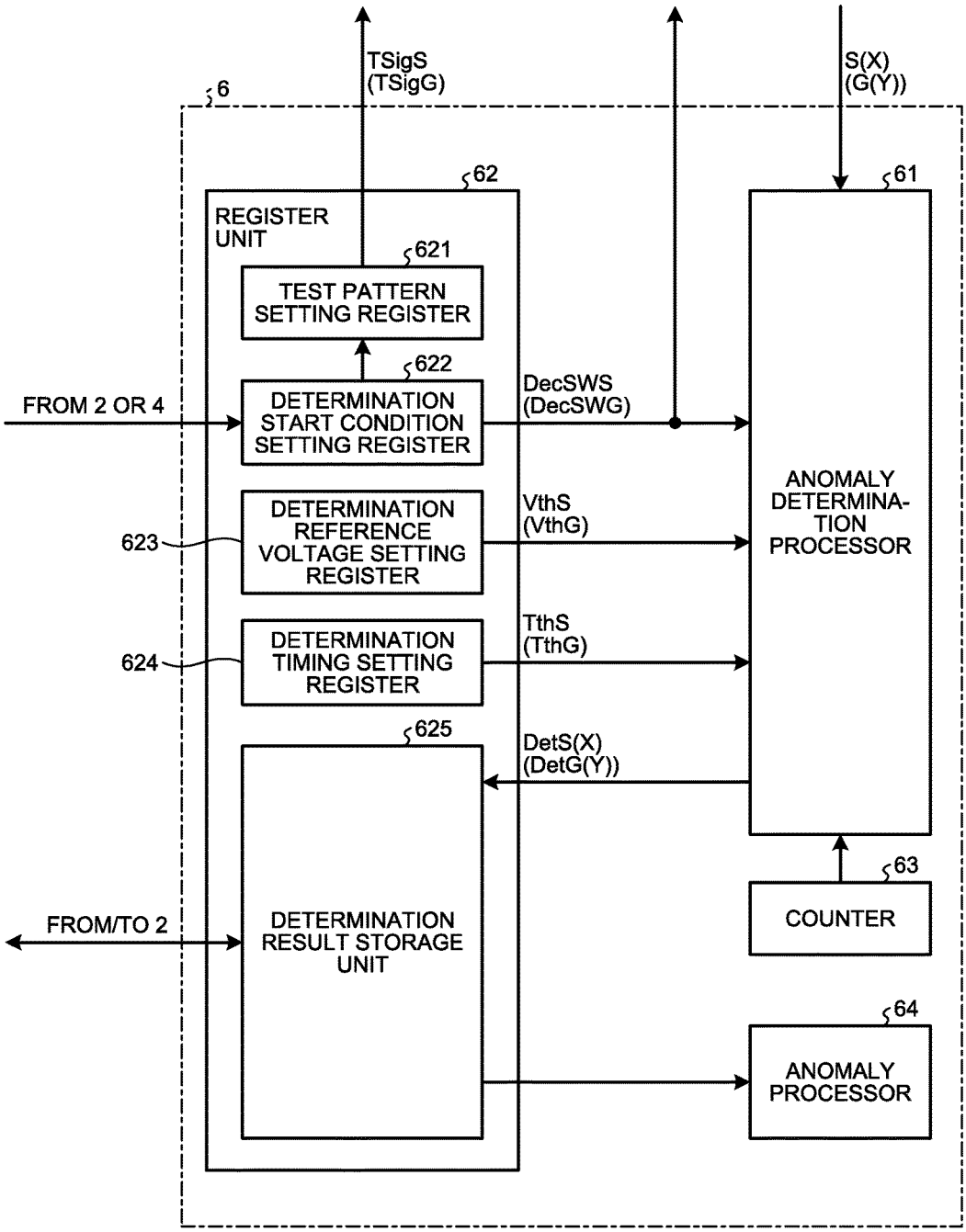
FIG. 5 is a diagram illustrating a configuration example of an anomaly detector in the display apparatus according to the first embodiment.
Figure 6:
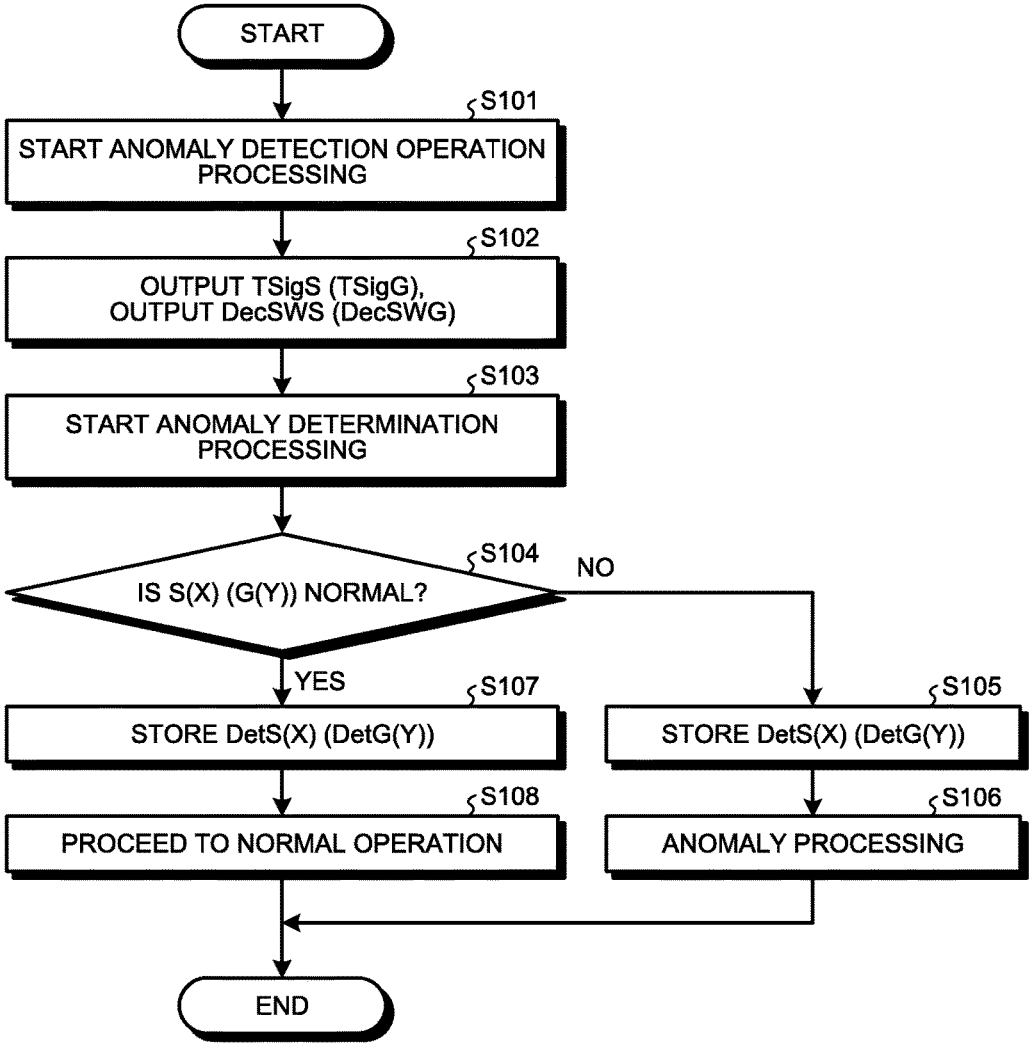
FIG. 6 is a diagram illustrating an example of anomaly detection processing of the display apparatus according to the first embodiment.

The following describes a configuration and an operation of the anomaly detector 6 according to the present embodiment for implementing the anomaly detection operation described above with reference to FIGS. 1 to 6. FIG. 5 is a diagram illustrating a configuration example of the anomaly detector in the display apparatus according to the first embodiment. FIG. 6 is a diagram illustrating an example of anomaly detection processing of the display apparatus according to the first embodiment.

As illustrated in FIG. 5, the anomaly detector 6 according to the present embodiment includes an anomaly determination processor 61, a register unit 62, a counter 63, and an anomaly processor 64. The anomaly determination processor 61 monitors the source drive signal S(X) (gate drive signal G(Y)) to determine whether the response characteristic of the source drive signal S(X) (gate drive signal G(Y)) is normal. The register unit 62 stores various settings, determination results, and the like in the anomaly detection operation. The counter 63 is used for acquiring a determination timing of the anomaly determination processor 61. The anomaly processor 64 performs predetermined anomaly processing based on the determination result obtained by the anomaly determination processor 61. The anomaly processing is predetermined processing that is performed when it is determined that anomaly has occurred. The anomaly processor 64 is a processor that performs the predetermined processing (anomaly processing) when it is determined that anomaly has occurred.

The register unit 62 includes a test pattern setting register 621, a determination start condition setting register 622, a determination reference voltage setting register 623, a determination timing setting register 624, and a determination result storage unit 625. The test pattern setting register 621 is a resister in which a test pattern of the source signal for testing TSigS (gate signal for testing TSigG) is set. The determination start condition setting register 622 is a register in which a condition for starting the anomaly detection operation is set. The determination reference voltage setting register 623 is a register in which a source signal determination reference voltage VthS (gate signal determination voltage threshold VthG) of the response characteristic of each source drive signal S(X) (gate drive signal G(Y)) in the anomaly determination processor 61 is set. The determination timing setting register 624 is a register in which the source signal determination timing TthS (gate signal determination timing TthG) of the response characteristic of each source drive signal S(X) (gate drive signal G(Y)) in the anomaly determination processor 61 is set. The determination result storage unit 625 is a register in which a source signal determination result DetS(X) (gate signal determination result DetG(Y)) of the response characteristic of each source drive signal S(X) (gate drive signal G(Y)) in the anomaly determination processor 61 is stored.

As described above, a condition for starting the anomaly detection operation is set in the determination start condition setting register 622. Specifically, for example, an event with activation of the display system 100 is set, as a determination start condition, such as start of power supply to the display apparatus 1 and an activation command for the display apparatus 1 output from the control apparatus 2. For example, an event like the following is set as the determination start condition: an event that can detect a non-display period such as a vertical blanking period (vertical retrace period) in the display apparatus 1, such as a vertical synchronizing signal output from a display controller 4.

The test pattern to be set in the register unit 62, the start condition for the anomaly detection operation, and various determination conditions including the source signal determination reference voltage VthS (gate signal determination voltage threshold VthG) and the source signal determination timing TthS (gate signal determination timing TthG) may be set in the register unit 62 in advance, or may be read from a host system, such as the control apparatus 2, at the time of activation of the display apparatus 1.

When an event matching with the determination start condition set in the determination start condition setting register 622 occurs, anomaly detection operation processing is started (Step S101). At this point, the register unit 62 outputs the source signal for testing TSigS (gate signal for testing TSigG) set in the test pattern setting register 621, and outputs the source signal line anomaly detection operation start signal DecSWS (gate signal line anomaly detection operation start signal DecSWG) (Step S102). As described above, the source signal for testing TSigS (gate signal for testing TSigG) in the present embodiment is a voltage signal having a stepped waveform that is changed from the first potential V1 to the second potential V2 higher than the first potential V1 at the predetermined time T0 as illustrated in FIG. 4. The source signal line anomaly detection operation start signal DecSWS (gate signal line anomaly detection operation start signal DecSWG) is output at rise time T0 of the source signal for testing TSigS (gate signal for testing TSigG).

When detecting the source signal for testing TSigS (gate signal for testing TSigG), the anomaly determination processor 61 starts to perform the anomaly determination processing for each source drive signal S(X) (gate drive signal G(Y)) (Step S103). More specifically, the anomaly determination processor 61 starts to observe each source drive signal S(X) (gate drive signal G(Y)), and starts to count elapsed time from the time T0 at which the source signal for testing TSigS (gate signal for testing TSigG) is detected.

The anomaly determination processor 61 determines whether the response characteristic of each source drive signal S(X) (gate drive signal G(Y)) is normal based on the source signal determination reference voltage VthS (gate signal determination voltage threshold VthG) set in the determination reference voltage setting register 623 of the register unit 62 and the source signal determination timing TthS (gate signal determination timing TthG) set in the determination timing setting register 624 of the register unit 62 (Step S104).

If the response characteristic of each source drive signal S(X) (gate drive signal G(Y)) is not normal (No at Step S104), the anomaly determination processor 61 stores, in the determination result storage unit 625 of the register unit 62, the source signal determination result DetS(X) (gate signal determination result DetG(Y)) indicating that the response characteristic of each source drive signal S(X) (gate drive signal G(Y)) is abnormal (Step S105).

The anomaly processor 64 refers to the source signal determination result DetS(X) (gate signal determination result DetG(Y)) stored at Step S105, performs predetermined anomaly processing based on the determination result (Step S106), and ends the processing in this procedure.

Figure 7:
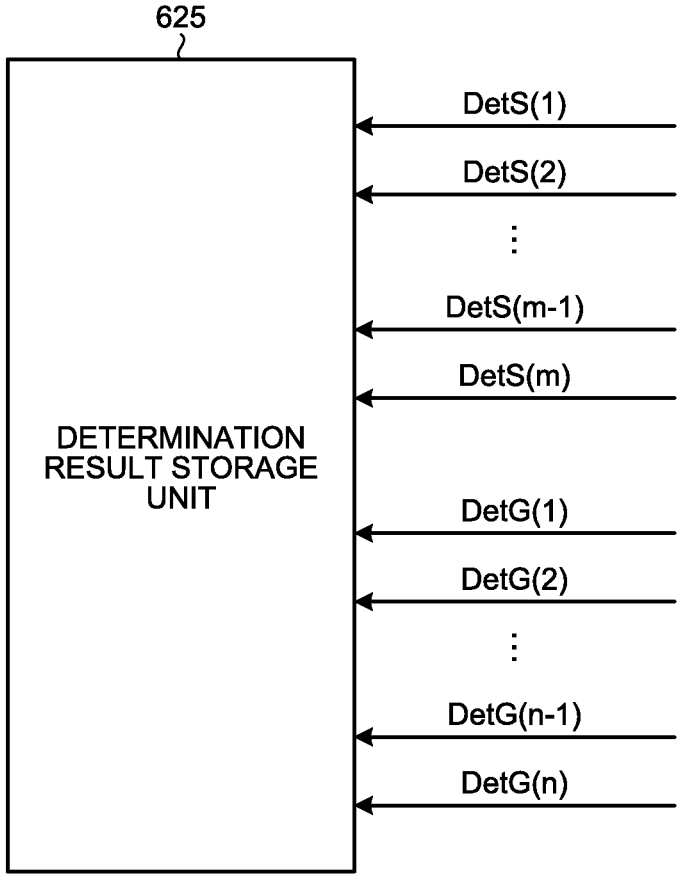
FIG. 7 is a diagram illustrating an example of an input configuration of each source signal determination result and each gate signal determination result with respect to a determination result storage unit.

FIG. 7 is a diagram illustrating an example of an input configuration of each source signal determination result and each gate signal determination result with respect to the determination result storage unit. FIG. 8 is a diagram illustrating an example of each source signal determination result and each gate signal determination result stored in the determination result storage unit.

In the example illustrated in FIG. 7, each of the source signal determination results DetS(1), DetS(2), . . . , DetS (m−1), and DetS(m) and each of the gate signal determination results DetG(1), DetG(2), . . . , DetG(n−1), and DetG(n) are input to the determination result storage unit 625, and as illustrated in FIG. 8, each source signal determination result DetS(X) and each gate signal determination result DetG(Y) are stored in the determination result storage unit 625. In the example illustrated in FIG. 8, a value "0" is stored as a normal determination result in each source signal determination result DetS(X) (gate signal determination result DetG (Y)) when the response characteristic of each source drive signal S(X) (gate drive signal G(Y)) is normal, and the value "1" is stored as an anomaly determination result in each source signal determination result DetS(X) (gate signal determination result DetG(Y)) when the response characteristic of each source drive signal S(X) (gate drive signal G(Y)) is abnormal. The anomaly determination result of each source signal determination result DetS(X) is also referred to as a "first anomaly determination result". The anomaly determination result of each gate signal determination result DetG(Y) is also referred to as a "second anomaly determination result".

In the example illustrated in FIG. 8, the source signal determination result DetS(a) has the value "1" (first anomaly determination result) and the gate signal determination result DetG(b) has the value "1" (second anomaly determination result), so that the response characteristics of the source drive signal S(a) and the gate drive signal G(b) are found to be abnormal. That is, in the example illustrated in FIG. 8, it can be found that anomaly occurs in the pixel 21*p* at coordinates (a, b).

In the example illustrated in FIG. 8, the number of anomaly occurrence spots indicating the first anomaly determination result and the second anomaly determination result is one. However, anomaly may occur at a plurality of spots in the display region 21 if damage occurs in the display region 21 on the glass substrate 11 or the element included in the display region 21 is deteriorated, for example. According to the present embodiment, distribution of anomaly occurrence spots indicating the first anomaly determination result and the second anomaly determination result can be detected by referring to each of the source signal determination results DetS(1), DetS(2), . . . , DetS(m−1), and DetS(m) and each of the gate signal determination results DetG(1), DetG(2), . . . , DetG(n−1), and DetG(n) illustrated in FIG. 8, so that, in accordance with a distribution status of the anomaly occurrence spots indicating the first anomaly determination result and the second anomaly determination result, anomaly processing like the followings can be performed: stopping activation of the display apparatus 1, reactivating the display apparatus 1, and displaying an image in a region excluding the anomaly occurrence spot.

Returning to FIG. 6, if the response characteristic of each source drive signal S(X) (gate drive signal G(Y)) is normal (Yes at Step S104), the anomaly determination processor 61 stores, in the determination result storage unit 625 of the register unit 62, the source signal determination result DetS (X) (gate signal determination result DetG(Y)) indicating that the response characteristic of each source drive signal S(X) (gate drive signal G(Y)) is normal (Step S107). In this case, the anomaly processor 64 does not perform anomaly processing, the process proceeds to a normal operation of performing normal image display in the display region 21 (Step S108), and the processing in this procedure is ended. Accordingly, an operation of the display apparatus 1 is shifted to the normal operation of performing normal image display in the display region 21.

As described above, note that each source signal line (signal line) DTL and each gate signal line (scanning line) SCL in the display region 21 are represented as the equivalent circuit in which the time constant circuits each including the resistance element R and the electrostatic capacitive element C are coupled in series, a change in the response characteristic of the source drive signal S(X) (gate drive signal G(Y)) is detected, the change being caused by a change in the time constant of the source signal line equivalent circuit 211X for each of the pixel columns that correspond to the respective source signal lines (signal lines) DTL and the gate signal line equivalent circuit 211Y for each of the pixel rows that correspond to the respective gate signal lines (scanning lines) SCL, so that the display apparatus 1 according to the first embodiment can detect deterioration in the display region 21.

By causing each of the source signal for testing TSigS and the gate signal for testing TSigG used for the anomaly detection operation to be the voltage signal having a stepped waveform that is changed from the first potential V1 to the second potential V2 higher than the first potential V1 at the predetermined time T0, the test pattern can be generated with a simple configuration without requiring a complicated circuit or computer program, and the like.

By performing anomaly determination by detecting a change in the response characteristic of the source drive signal S(X) and a change in the response characteristic of the gate drive signal G(Y), distribution of the anomaly occurrence spots in the display region 21 can be detected. Accordingly, anomaly processing corresponding to the distribution status of the anomaly occurrence spots can be implemented.

Second Embodiment

In the first embodiment, the anomaly detection operation is performed for detecting damage, deterioration, and the like in the display region 21 based on a change in the response characteristic of the source drive signal S(X) (gate drive signal G(Y)). A second embodiment describes a more specific anomaly detection method.

Figure 9:
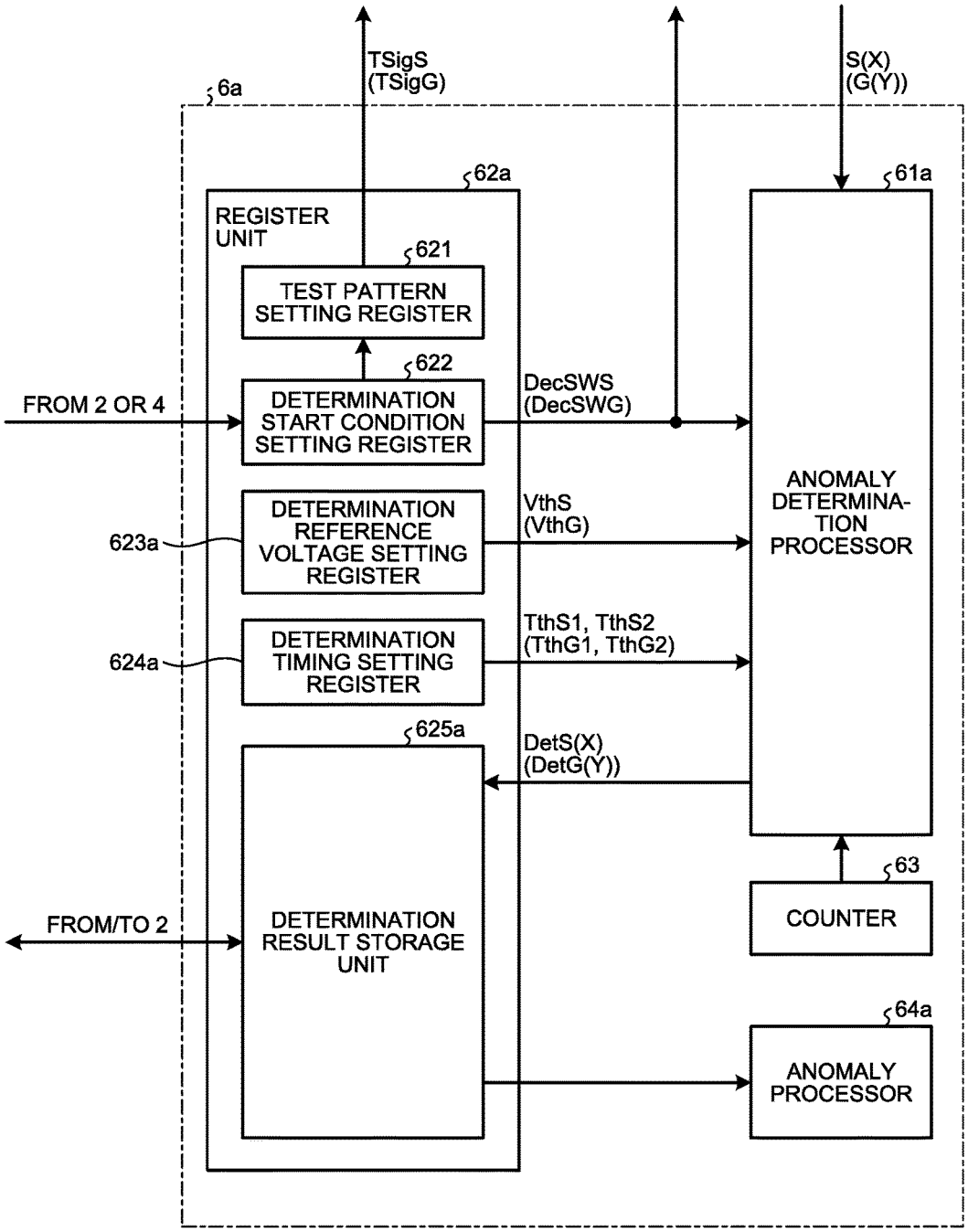
FIG. 9 is a diagram illustrating a configuration example of an anomaly detector in a display apparatus according to a second embodiment.
Figure 10A:
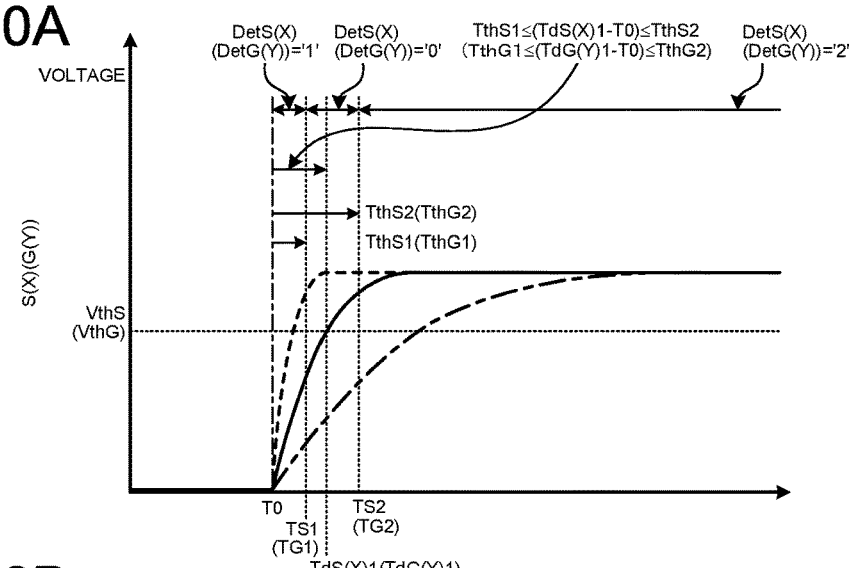
FIGS. 10A to 10C are diagrams illustrating an example of an anomaly detection method of the display apparatus according to the second embodiment.
Figure 10B:
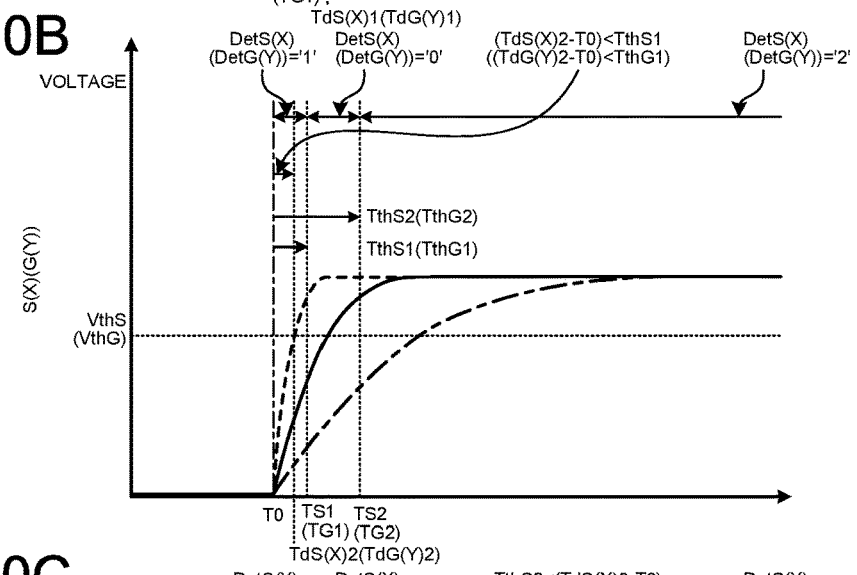
Figure 10C:
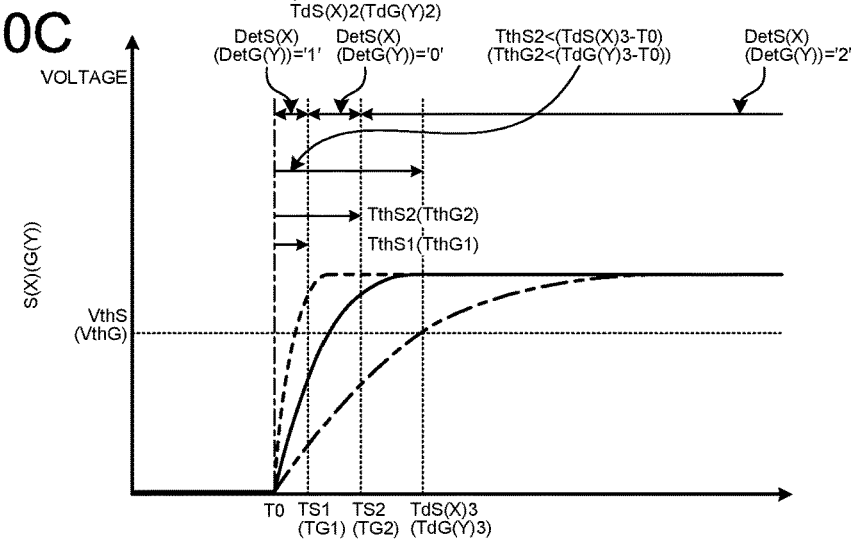
Figure 11:
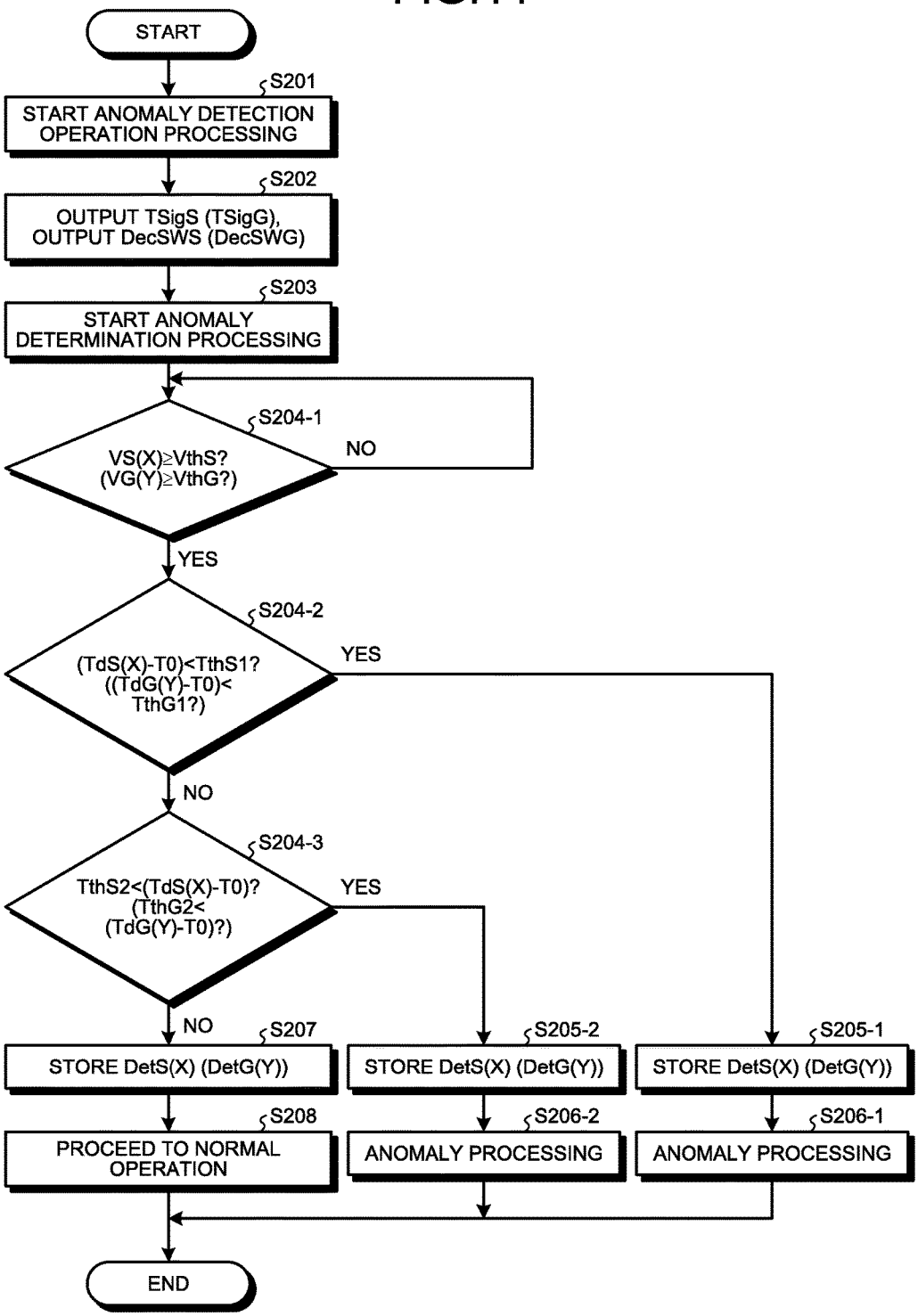
FIG. 11 is a diagram illustrating an example of anomaly detection processing of the display apparatus according to the second embodiment.
Figure 12:
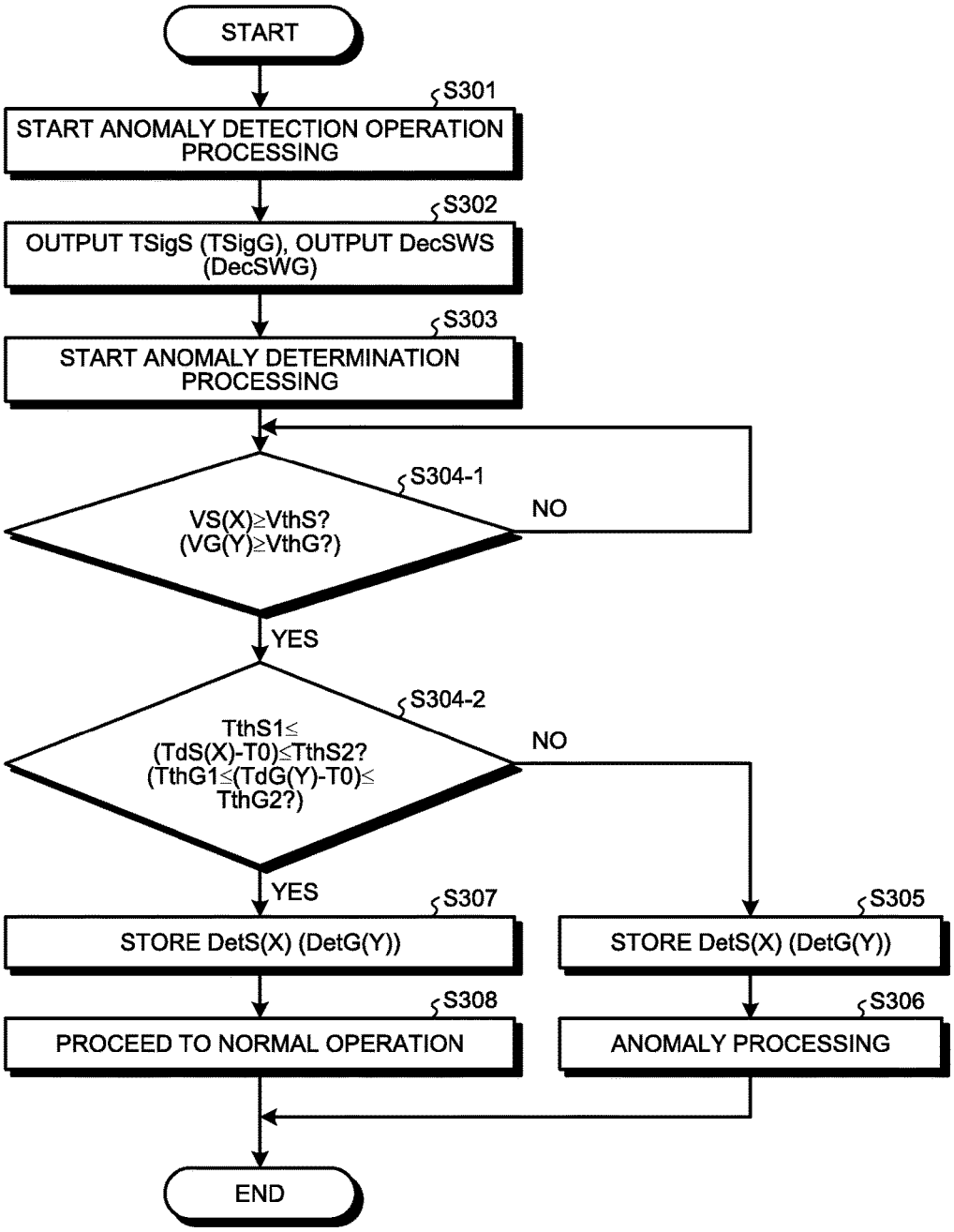
FIG. 12 is a diagram illustrating an example of anomaly detection processing of the display apparatus according to the second embodiment, the anomaly detection processing being different from that in FIG. 11.

FIG. 9 is a diagram illustrating a configuration example of the anomaly detector in the display apparatus according to the second embodiment. FIGS. 10A to 10C are diagrams illustrating an example of the anomaly detection method of the display apparatus according to the second embodiment. FIG. 11 is a diagram illustrating an example of the anomaly detection processing of the display apparatus according to the second embodiment. FIG. 12 is a diagram illustrating an example of the anomaly detection processing of the display apparatus according to the second embodiment, the anomaly detection processing being different from that in FIG. 11. A schematic configuration of the display system to which the display apparatus according to the second embodiment is applied and a block configuration of the display apparatus according to the second embodiment are the same as those in the first embodiment described above, so that redundant description will not be repeated.

First, with reference to FIG. 9, the following describes a configuration of an anomaly detector 6*a* in the display apparatus according to the second embodiment.

In the example illustrated in FIG. 9, a voltage threshold is set, in a determination reference voltage setting register 623*a* of a register unit 62*a*, as the source signal determination reference voltage VthS (gate signal determination voltage threshold VthG) of the response characteristic of each source drive signal S(X) (gate drive signal G(Y)) in an anomaly determination processor 61*a*. In the present embodiment, the source signal determination reference voltage VthS is referred to as the "source signal determination voltage threshold VthS" for the response characteristic of each source drive signal S(X), and the gate signal determination voltage threshold VthG is referred to as the "gate signal determination voltage threshold VthG" for the response characteristic of each gate drive signal G(Y).

In a determination timing setting register 624*a* of the register unit 62*a*, a first elapsed time threshold for measuring elapsed time from the predetermined time T0 and a second elapsed time threshold longer than the first elapsed time threshold are set as the source signal determination timing TthS (gate signal determination timing TthG) of the response characteristic of each source drive signal S(X) (gate drive signal G(Y)) in the anomaly determination processor 61*a*. In the present embodiment, a "source signal first elapsed time threshold TthS1" and a "source signal second elapsed time threshold TthS2" are set as the source signal determination timing for the response characteristic of each source drive signal S(X), and a "gate signal first elapsed time threshold TthG1" and a "gate signal second elapsed time threshold TthG2" are set as the gate signal determination timing for the response characteristic of each gate drive signal G(Y).

Next, with reference to FIGS. 10A to 10C, the following describes the anomaly detection method of the display apparatus according to the second embodiment.

In the example illustrated in FIGS. 10A to 10C, a solid line indicates the response characteristic of the source drive signal S(X) (gate drive signal G(Y)) in a normal condition in which the source signal line (signal line) DTL (gate signal line (scanning line) SCL) is not broken or the element included in the display region 21 is not deteriorated. A dashed line indicates the response characteristic in a case in which, for example, the source signal line (signal line) DTL (gate signal line (scanning line) SCL) is broken due to damage in the display region 21 and the time constant of the source signal line equivalent circuit 211X (gate signal line equivalent circuit 211Y) is reduced due to a defect and the like in the electrostatic capacitance component C at a later stage than a broken part. Thus, the dashed line rises more steeply than the response characteristic in the normal condition. An alternate long and short dash line indicates the response characteristic in a case in which, for example, the element included in the display region 21 is deteriorated and the time constant of the source signal line equivalent circuit 211X (gate signal line equivalent circuit 211Y) is increased due to an increase and the like in the electrostatic capacitance component C. Thus, the alternate long and short dash line rises more gently than the response characteristic in the normal condition.

In the present embodiment, as described above, the source signal determination voltage threshold VthS for the response characteristic of each source drive signal S(X) and the gate signal determination voltage threshold VthG for the response characteristic of each gate drive signal G(Y) are set in the determination reference voltage setting register 623*a* of the register unit 62*a*. As described above, in the determination timing setting register 624*a* of the register unit 62*a*, the source signal first elapsed time threshold TthS1 and the source signal second elapsed time threshold TthS2 for the response characteristic of each source drive signal S(X) are set, and the gate signal first elapsed time threshold TthG1 and the gate signal second elapsed time threshold TthG2 for the response characteristic of each gate drive signal G(Y) are set.

In the example illustrated in FIG. 10A, regarding the response characteristic in the normal condition indicated by the solid line, elapsed time (TdS(X)1-T0) (elapsed time (TdG(Y)1-T0)) is equal to or larger than the source signal first elapsed time threshold TthS1 (gate signal first elapsed time threshold TthG1) and equal to or smaller than the source signal second elapsed time threshold TthS2 (gate signal second elapsed time threshold TthG2). The elapsed time (TdS(X)1-T0) (elapsed time (TdG(Y)1-T0)) is the amount of time that passes from the predetermined time T0 to time TdS(X)1 (TdG(Y)1) at which the source signal determination voltage threshold VthS (gate signal determination voltage threshold VthG) is reached. That is, FIG. 10A illustrates TthS1 ≤(TdS(X)1-T0) ≤TthS2, and TthG1 ≤(TdG(Y)1-T0)≤TthG2. In this case, the anomaly detector 6*a* according to the present embodiment stores a value "0" as the source signal determination result DetS(X) (gate signal determination result DetG(Y)) in a determination result storage unit 625*a*.

In the example illustrated in FIG. 10B, regarding the response characteristic indicated by the dashed line rising more steeply than the response characteristic in the normal condition, elapsed time (TdS(X)2-T0) (elapsed time (TdG(Y)2-T0)) is smaller than the source signal first elapsed time threshold TthS1 (gate signal first elapsed time threshold TthG1). The elapsed time (TdS(X)2-T0) (elapsed time (TdG(Y)2-T0)) is the amount of time that passes from the predetermined time T0 to time TdS(X)2 (TdG(Y)2) at which the source signal determination voltage threshold VthS (gate signal determination voltage threshold VthG) is reached. That is, FIG. 10B illustrates (TdS(X)2-T0) <TthS1, and (TdG(Y)2-T0)<TthG1. In this case, the anomaly detector 6*a* according to the present embodiment stores a value "1" (first anomaly determination result (second anomaly determination result)) as the source signal determination result DetS(X) (gate signal determination result DetG(Y)) in the determination result storage unit 625*a*.

In the example illustrated in FIG. 10C, regarding the response characteristic indicated by the alternate long and short dash line rising more gently than the response characteristic in the normal condition, elapsed time (TdS(X)3-T0) (elapsed time (TdG(Y)3-T0)) is larger than the source signal second elapsed time threshold TthS2 (gate signal second elapsed time threshold TthG2). The elapsed time (TdS(X)3-T0) (elapsed time (TdG(Y)3-T0)) is the amount of time that passes from the predetermined time T0 to time TdS(X)3 (TdG(Y)3) at which the source signal determination voltage threshold VthS (gate signal determination voltage threshold VthG) is reached. That is, FIG. 10C illustrates TthS2<(TdS(X)3-T0), and TthG2<(TdG(Y)3-T0). In this case, the anomaly detector 6*a* according to the present embodiment stores a value "2" (first anomaly determination result (second anomaly determination result)) as the source signal determination result DetS(X) (gate signal determination result DetG(Y)) in the determination result storage unit 625*a*.

An anomaly processor 64*a* according to the present embodiment refers to the source signal determination result DetS(X) (gate signal determination result DetG(Y)) stored in the determination result storage unit 625*a*, and performs predetermined anomaly processing based on the determination result. As described above, in the present embodiment, the source signal determination result DetS(X) (gate signal determination result DetG(Y)) is stored in the determination result storage unit 625*a*, the value of the source signal determination result DetS(X) being different between a first case and a second case. The source signal determination result DetS(X) and the gate signal determination result DetG(Y) correspond to the first anomaly determination result and the second anomaly determination result, respectively. The first case is a case in which the elapsed time (TdS(X)2-T0) (elapsed time (TdG(Y)2-T0)) is smaller than the source signal first elapsed time threshold TthS1 (gate signal first elapsed time threshold TthG1). The elapsed time (TdS(X)2-T0) (elapsed time (TdG(Y)2-T0)) is the amount of time that passes from the predetermined time T0 to the time TdS(X)2 (TdG(Y)2) at which the source signal determination voltage threshold VthS (gate signal determination voltage threshold VthG) is reached. The second case is a case in which the elapsed time (TdS(X)3-T0) (elapsed time (TdG(Y)3-T0)) is larger than the source signal second elapsed time threshold TthS2 (gate signal second elapsed time threshold TthG2). The elapsed time (TdS(X)3-T0) (elapsed time (TdG(Y)3-T0)) is the amount of time that passes from the predetermined time T0 to the time TdS(X)3 (TdG(Y)3) at which the source signal determination voltage threshold VthS (gate signal determination voltage threshold VthG) is reached. The anomaly processor 64*a* according to the present embodiment can therefore perform, for example, anomaly processing different between a case in which the source signal line (signal line) DTL (gate signal line (scanning line) SCL) is broken and the time constant of the source signal line equivalent circuit 211X (gate signal line equivalent circuit 211Y) is reduced, and a case in which the element included in the display region 21 is deteriorated and the time constant of the source signal line equivalent circuit 211X (gate signal line equivalent circuit 211Y) is increased due to an increase and the like in the electrostatic capacitance component C.

Next, with reference to FIG. 11, the following describes the anomaly detection method of the display apparatus according to the second embodiment.

When an event matching with the determination start condition set in the determination start condition setting register 622 occurs, anomaly detection operation processing is started (Step S201). At this point, the register unit 62*a* outputs the source signal for testing TSigS (gate signal for testing TSigG) set in the test pattern setting register 621, and outputs the source signal line anomaly detection operation start signal DecSWS (gate signal line anomaly detection operation start signal DecSWG) (Step S202). As with the first embodiment, the source signal for testing TSigS (gate signal for testing TSigG) according to the present embodiment is a voltage signal having a stepped waveform that is changed from the first potential V1 to the second potential V2 higher than the first potential V1 at the predetermined time T0. The source signal line anomaly detection operation start signal DecSWS (gate signal line anomaly detection operation start signal DecSWG) is output at the rise time T0 of the source signal for testing TSigS (gate signal for testing TSigG).

When detecting the source signal for testing TSigS (gate signal for testing TSigG), the anomaly determination processor 61*a* starts to perform anomaly determination processing on each source drive signal S(X) (gate drive signal G(Y)) (Step S203). More specifically, the anomaly determination processor 61*a* starts to observe each source drive signal S(X) (gate drive signal G(Y)), and starts to count elapsed time from the time T0 at which the source signal for testing TSigS (gate signal for testing TSigG) is detected.

The anomaly determination processor 61*a* compares a voltage value VS(X) of each input source drive signal S(X) (a voltage value VG(Y) of the gate drive signal G(Y)) with the source signal determination voltage threshold VthS (gate signal determination voltage threshold VthG) set in the determination reference voltage setting register 623*a* of the register unit 62*a* (Step S204-1), and repeats the processing at Step S204-1 until when the voltage value VS(X) of each source drive signal S(X) (the voltage value VG(Y) of the gate drive signal G(Y)) becomes equal to or larger than the source signal determination voltage threshold VthS (gate signal determination voltage threshold VthG) (No at Step S204-1).

If the voltage value VS(X) of each source drive signal S(X) (the voltage value VG(Y) of the gate drive signal G(Y)) becomes equal to or larger than the source signal determination voltage threshold VthS (gate signal determination voltage threshold VthG) (Yes at Step S204-1), the anomaly determination processor 61*a* determines whether elapsed time (TdS(X)-T0) (elapsed time (TdG(Y)-T0)) from the predetermined time T0 at time TdS (TdG) is smaller than the source signal first elapsed time threshold TthS1 (gate signal first elapsed time threshold TthG1) ((TdS(X)-T0)<TthS1, (TdG(Y)-T0)<TthG1) (Step S204-2).

If the elapsed time (TdS(X)-T0) (elapsed time (TdG(Y)-T0)) from the predetermined time T0 at the time TdS(X) (time TdG(Y)) is smaller than the source signal first elapsed time threshold TthS1 (gate signal first elapsed time threshold TthG1) (Yes at Step S204-2), the anomaly determination processor 61*a* stores, in the determination result storage unit 625*a* of the register unit 62*a*, the source signal determination result DetS(X) (gate signal determination result DetG(Y)) indicating that the response characteristic of each source drive signal S(X) (gate drive signal G(Y)) rises more steeply than that in the normal condition (Step S205-1).

The anomaly processor 64*a* refers to the source signal determination result DetS(X) (gate signal determination result DetG(Y)) stored at Step S205-1, performs predetermined anomaly processing based on the determination result (Step S206-1), and ends the processing in this procedure.

If the elapsed time (TdS(X)-T0) (elapsed time (TdG(Y)-T0)) from the predetermined time T0 at the time TdS(X) (time TdG(Y)) is equal to or larger than the source signal first elapsed time threshold TthS1 (gate signal first elapsed time threshold TthG1) (No at Step S204-2), the anomaly determination processor 61*a* determines whether the elapsed time (TdS(X)-T0) (elapsed time (TdG(Y)-T0)) from the predetermined time T0 at the time TdS(X) (TdG(Y)) is larger than the source signal second elapsed time threshold TthS2 (gate signal second elapsed time threshold TthG2) (TthS2<(TdS (X)-T0), TthG2<(TdG (Y)-T0)) (Step S204-3).

If the elapsed time (TdS(X)-T0) (elapsed time (TdG(Y)-T0)) from the predetermined time T0 at the time TdS(X) (time TdG(Y)) is larger than the source signal second elapsed time threshold TthS2 (gate signal second elapsed time threshold TthG2) (Yes at Step S204-3), the anomaly determination processor 61*a* stores, in the determination result storage unit 625*a* of the register unit 62*a*, the source signal determination result DetS(X) (gate signal determination result DetG(Y)) indicating that the response characteristic of each source drive signal S(X) (gate drive signal G(Y)) rises more gently than that in the normal condition (Step S205-2).

The anomaly processor 64*a* refers to the source signal determination result DetS(X) (gate signal determination result DetG(Y)) stored at Step S205-2, performs predetermined anomaly processing based on the determination result (Step S206-2), and ends the processing in this procedure.

If the elapsed time (TdS(X)-T0) (elapsed time (TdG(Y)-T0)) from the predetermined time T0 at the time TdS(X) (TdG(Y)) is smaller than the source signal second elapsed time threshold TthS2 (gate signal second elapsed time threshold TthG2) (No at Step S204-3), the anomaly determination processor 61*a* stores, in the determination result storage unit 625*a* of the register unit 62*a*, the source signal determination result DetS(X) (gate signal determination result DetG(Y)) indicating that the response characteristic of each source drive signal S(X) (gate drive signal G(Y)) is normal (Step S207). In this case, the anomaly processing is not performed by the anomaly processor 64*a*, the process proceeds to a normal operation of performing normal image display in the display region 21 (Step S208), and the processing in this procedure is ended. Thus, the process performed by the display apparatus 1 proceeds to the normal operation of performing normal image display in the display region 21.

Next, with reference to FIG. 12, the following describes anomaly detection processing different from that in the example illustrated in FIG. 11 performed by the display apparatus according to the second embodiment.

When an event matching with the determination start condition set in the determination start condition setting register 622 occurs, anomaly detection operation processing is started (Step S301). At this point, the register unit 62*a* outputs the source signal for testing TSigS (gate signal for testing TSigG) set in the test pattern setting register 621, and outputs the source signal line anomaly detection operation start signal DecSWS (gate signal line anomaly detection operation start signal DecSWG) (Step S302). As with the first embodiment, the source signal for testing TSigS (gate signal for testing TSigG) in the present embodiment is a voltage signal having a stepped waveform that is changed from the first potential V1 to the second potential V2 higher than the first potential V1 at the predetermined time T0. The source signal line anomaly detection operation start signal DecSWS (gate signal line anomaly detection operation start signal DecSWG) is output at the rise time T0 of the source signal for testing TSigS (gate signal for testing TSigG).

When detecting the source signal for testing TSigS (gate signal for testing TSigG), the anomaly determination processor 61*a* starts to perform anomaly determination processing on each source drive signal S(X) (gate drive signal G(Y)) (Step S303). More specifically, the anomaly determination processor 61*a* starts to observe each source drive signal S(X) (gate drive signal G(Y)), and starts to count elapsed time from the time T0 at which the source signal for testing TSigS (gate signal for testing TSigG) is detected.

The anomaly determination processor 61*a* compares the voltage value VS(X) of each input source drive signal S(X) (the voltage value VG(Y) of the gate drive signal G(Y)) with the source signal determination voltage threshold VthS (gate signal determination voltage threshold VthG) set in the determination reference voltage setting register 623*a* of the register unit 62*a* (Step S304-1), and repeats the processing at Step S304-1 until when the voltage value VS(X) of each source drive signal S(X) (the voltage value VG(Y) of the gate drive signal G(Y)) becomes equal to or larger than the source signal determination voltage threshold VthS (gate signal determination voltage threshold VthG) (No at Step S304-1).

If the voltage value VS(X) of each source drive signal S(X) (the voltage value VG(Y) of the gate drive signal G(Y)) becomes equal to or larger than the source signal determination voltage threshold VthS (gate signal determination voltage threshold VthG) (Yes at Step S304-1), the anomaly determination processor 61*a* determines whether the elapsed time (TdS(X)-T0) (elapsed time (TdG(Y)-T0)) from the predetermined time T0 at the time TdS(X) (time TdG(Y)) is equal to or larger than the source signal first elapsed time threshold TthS1 (gate signal first elapsed time threshold TthG1) and equal to or smaller than the source signal second elapsed time threshold TthS2 (gate signal second elapsed time threshold TthG2) (TthS1≤(TdS(X)-T0) ≤TthS2, TthG1 ≤(TdG(Y)-T0) ≤TthG2) (Step S304-2).

If the elapsed time (TdS(X)-T0) (elapsed time (TdG(Y)-T0)) at the time TdS(X) (time TdG(Y)) at which the voltage value VS(X) of each source drive signal S(X) (the voltage value VG(Y) of the gate drive signal G(Y)) becomes equal to or larger than the source signal determination voltage threshold VthS (gate signal determination voltage threshold VthG) is smaller than the source signal first elapsed time threshold TthS1 (gate signal first elapsed time threshold TthG1) or larger than the source signal second elapsed time threshold TthS2 (gate signal second elapsed time threshold TthG2) (No at Step S304-2), the anomaly determination processor 61*a* stores, in the determination result storage unit 625*a* of the register unit 62*a*, the source signal determination result DetS(X) (gate signal determination result DetG(Y)) indicating that the response characteristic of each source drive signal S(X) (gate drive signal G(Y)) is abnormal (Step S305).

The anomaly processor 64*a* refers to the source signal determination result DetS(X) (gate signal determination result DetG(Y)) stored at Step S305, performs predetermined anomaly processing based on the determination result (Step S306), and ends the processing in this procedure.

If the elapsed time (TdS(X)-T0) (elapsed time (TdG(Y)-T0)) at the time TdS(X) (time TdG(Y)) at which the voltage value VS(X) of each source drive signal S(X) (the voltage value VG(Y) of the gate drive signal G(Y)) becomes equal to or larger than the source signal determination voltage threshold VthS (gate signal determination voltage threshold VthG) is equal to or larger than the source signal first elapsed time threshold TthS1 (gate signal first elapsed time threshold TthG1) and equal to or smaller than the source signal second elapsed time threshold TthS2 (gate signal second elapsed time threshold TthG2) (Yes at Step S304-2), the anomaly determination processor 61*a* stores, in the determination result storage unit 625*a* of the register unit 62*a*, the source signal determination result DetS(X) (gate signal determination result DetG(Y)) indicating that the response characteristic of each source drive signal S(X) (gate drive signal G(Y)) is normal (Step S307). In this case, the anomaly processing is not performed by the anomaly processor 64*a*, the process proceeds to a normal operation of performing normal image display in the display region 21 (Step S308), and the processing in this procedure is ended. Thus, the process performed by the display apparatus 1 proceeds to the normal operation of performing normal image display in the display region 21.

Through the anomaly detection processing illustrated in FIG. 12, it can be determined only whether the response characteristic of each source drive signal S(X) (gate drive signal G(Y)) is normal, and it cannot be detected whether the response characteristic of each source drive signal S(X) (gate drive signal G(Y)) rises more steeply than that in the normal condition or whether the response characteristic of each source drive signal S(X) (gate drive signal G(Y)) rises more gently than that in the normal condition. In the anomaly detection processing illustrated in FIG. 11, as described above with reference to FIGS. 10A to 10C, the source signal determination result DetS(X) (gate signal determination result DetG(Y)) of different values can be stored in the determination result storage unit 625*a*, the values being different between the case in which the response characteristic of each source drive signal S(X) (gate drive signal G(Y)) rises more steeply than that in the normal condition and the case in which the response characteristic of each source drive signal S(X) (gate drive signal G(Y)) rises more gently than that in the normal condition. The source signal determination result DetS(X) and the gate signal determination result DetG(Y) correspond to the first anomaly determination result and the second anomaly determination result, respectively. Accordingly, the anomaly processor 64*a* according to the present embodiment can perform, for example, anomaly processing different between the case in which the source signal line (signal line) DTL (gate signal line (scanning line) SCL) is broken and the time constant of the source signal line equivalent circuit 211X (gate signal line equivalent circuit 211Y) is reduced, and the case in which the element included in the display region 21 is deteriorated and the time constant of the source signal line equivalent circuit 211X (gate signal line equivalent circuit 211Y) is increased due to an increase and the like in the electrostatic capacitance component C.

As described above, in the anomaly detector 6*a* of the display apparatus 1 according to the second embodiment, the source signal determination voltage threshold VthS (gate signal determination voltage threshold VthG) for the response characteristic of each source drive signal S(X) (gate drive signal G(Y)) is set, and the source signal first elapsed time threshold TthS1 (gate signal first elapsed time threshold TthG1) for the response characteristic of each source drive signal S(X) (gate drive signal G(Y)) and the source signal second elapsed time threshold TthS2 (gate signal second elapsed time threshold TthG2) longer than the source signal first elapsed time threshold TthS1 (gate signal first elapsed time threshold TthG1) are set.

With this configuration, the anomaly detector 6*a* determines that the response characteristic of each source drive signal S(X) (gate drive signal G(Y)) is normal when the elapsed time (TdS(X)-T0) (elapsed time (TdG(Y)-T0)) is equal to or larger than the source signal first elapsed time threshold TthS1 (gate signal first elapsed time threshold TthG1) and equal to or smaller than the source signal second elapsed time threshold TthS2 (gate signal second elapsed time threshold TthG2). The anomaly detector 6*a* also determines that the response characteristic of each source drive signal S(X) (gate drive signal G(Y)) is abnormal when the elapsed time (TdS(X)-T0) (elapsed time (TdG(Y)-T0)) is smaller than the source signal first elapsed time threshold TthS1 (gate signal first elapsed time threshold TthG1) or larger than the source signal second elapsed time threshold TthS2 (gate signal second elapsed time threshold TthG2). The elapsed time (TdS(X)-T0) (elapsed time (TdG(Y)-T0)) is the amount of time that passes from the predetermined time T0 to time TdS(X) (time TdG(Y)) at which the voltage value VS(X) of each source drive signal S(X) (the voltage value VG(Y) of the gate drive signal G(Y)) becomes equal to or larger than the source signal determination voltage threshold VthS (gate signal determination voltage threshold VthG).

Accordingly, the display apparatus 1 that can detect deterioration in the display region 21 can be implemented.

In the first case, the anomaly detector 6*a* can detect that the response characteristic of each source drive signal S(X) (gate drive signal G(Y)) rises more steeply than that in the normal condition. The first case is a case in which the elapsed time (TdS(X)-T0) (elapsed time (TdG(Y)-T0)) is smaller than the source signal first elapsed time threshold TthS1 (gate signal first elapsed time threshold TthG1). In the second case, the anomaly detector 6*a* can detect that the response characteristic of each source drive signal S(X) (gate drive signal G(Y)) rises more gently than that in the normal condition. The second case is a case in which the elapsed time (TdS(X)-T0) (elapsed time (TdG(Y)-T0)) at the time TdS(X) (time TdG(Y)) is larger than the source signal second elapsed time threshold TthS2 (gate signal second elapsed time threshold TthG2). The time TdS(X) (time TdG(Y)) in the first and second cases is time at which the voltage value VS(X) of each source drive signal S(X) (the voltage value VG(Y) of the gate drive signal G(Y)) becomes equal to or larger than the source signal determination voltage threshold VthS (gate signal determination voltage threshold VthG). Due to this, for example, the case in which the source signal line (signal line) DTL (gate signal line (scanning line) SCL) is broken and the time constant of the source signal line equivalent circuit 211X (gate signal line equivalent circuit 211Y) is reduced can be separated from the case in which the element included in the display region 21 is deteriorated and the time constant of the source signal line equivalent circuit 211X (gate signal line equivalent circuit 211Y) is increased due to an increase and the like in the electrostatic capacitance component C, so that appropriate anomaly processing can be performed.

Third Embodiment

The third embodiment describes an anomaly detection method different from that in the second embodiment.

Figure 13:
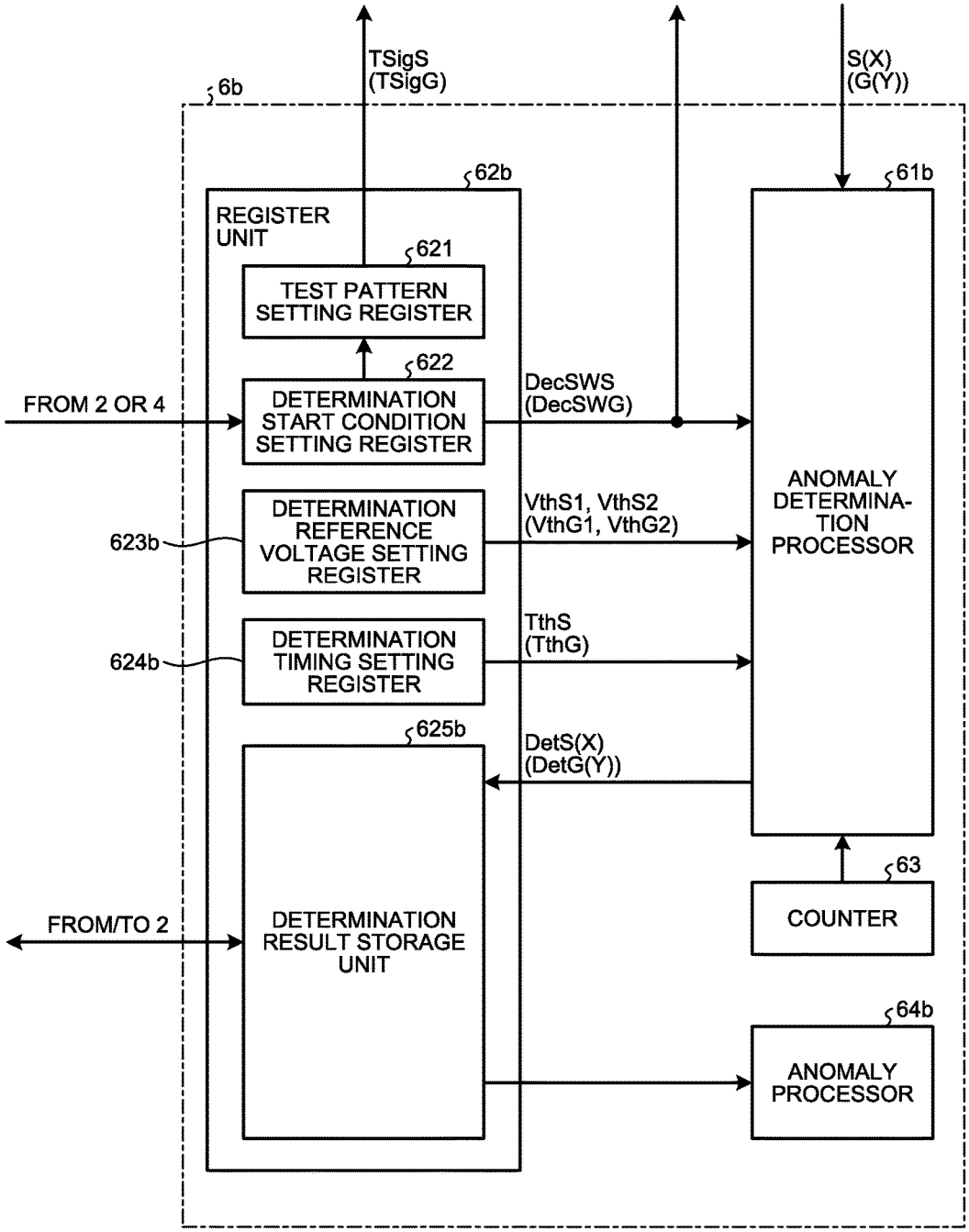
FIG. 13 is a diagram illustrating a configuration example of an anomaly detector in a display apparatus according to a third embodiment.
Figure 14A:
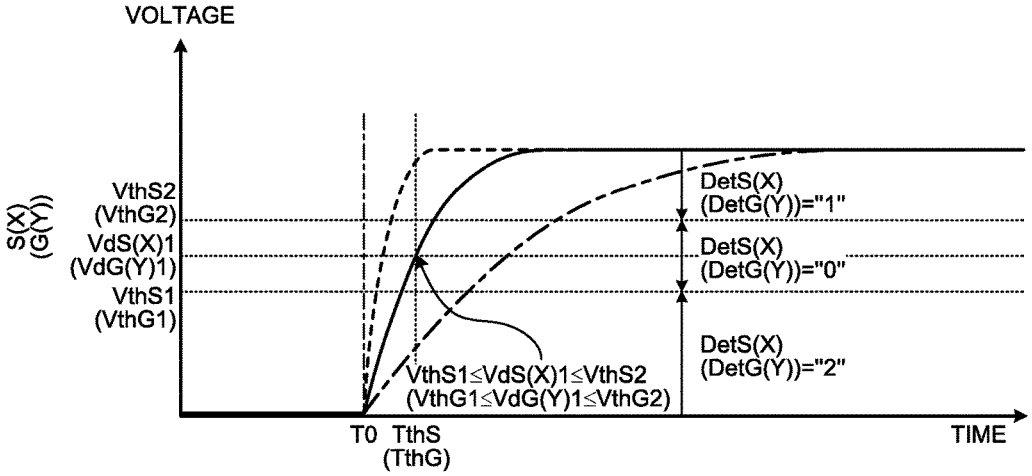
FIGS. 14A to 14C are diagrams illustrating an example of an anomaly detection method of the display apparatus according to the third embodiment.
Figure 14B:
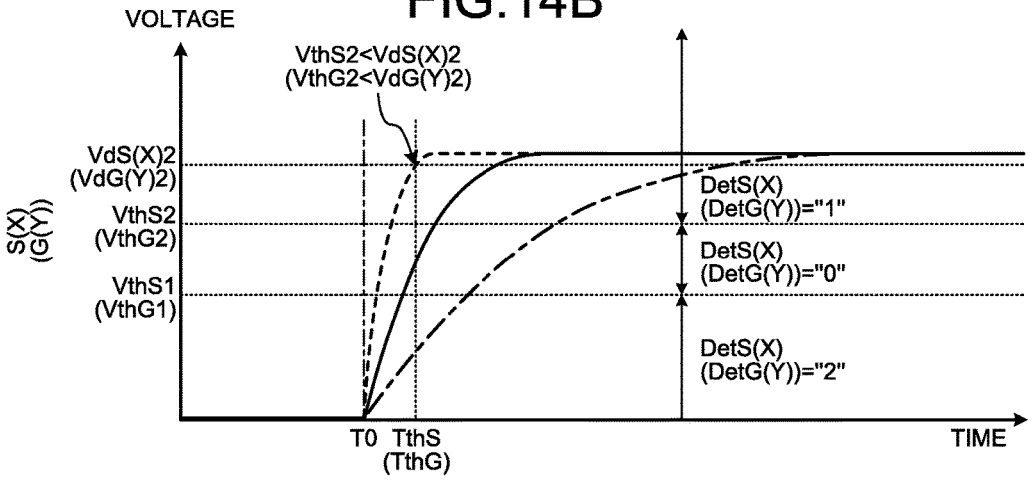
Figure 14C:
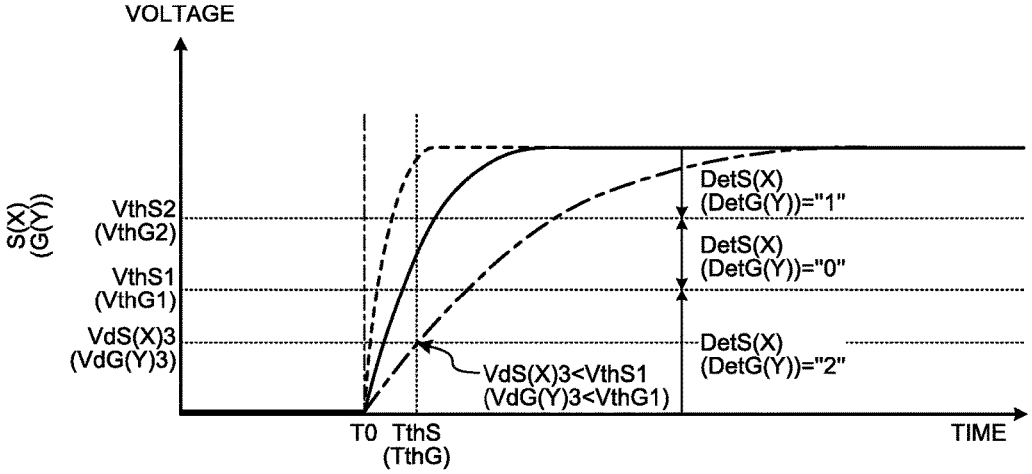
Figure 15:
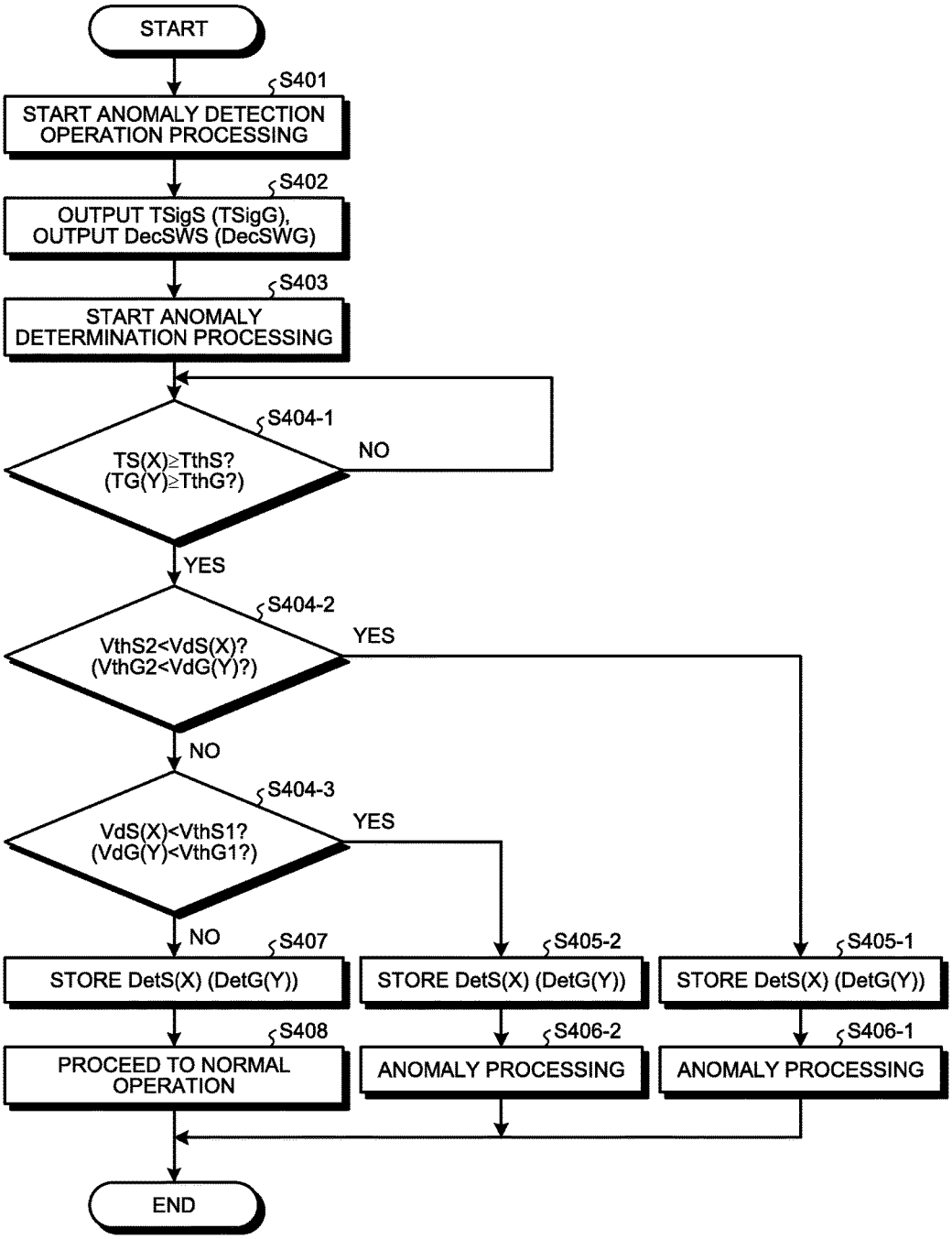
FIG. 15 is a diagram illustrating an example of anomaly detection processing of the display apparatus according to the third embodiment.
Figure 16:
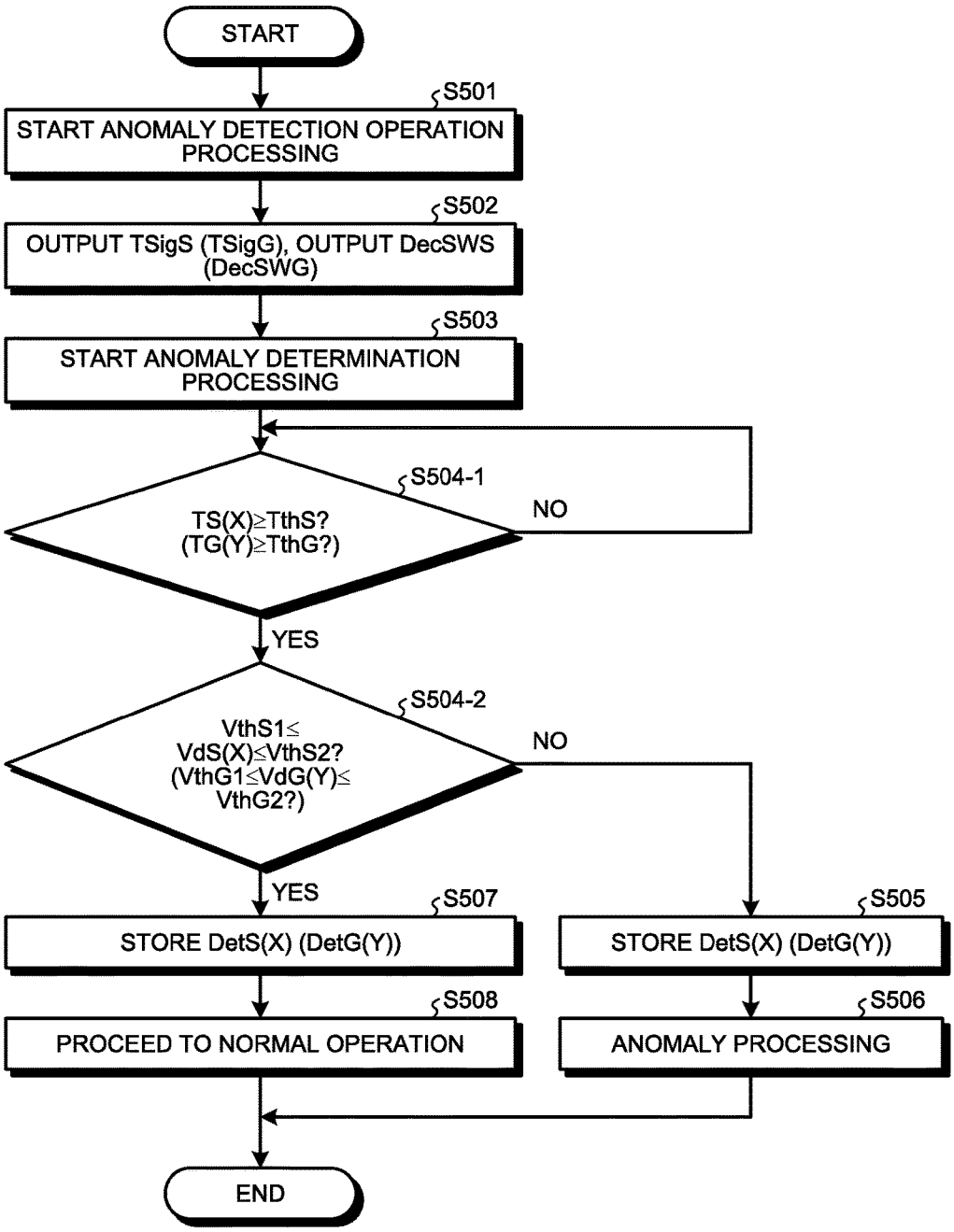
FIG. 16 is a diagram illustrating an example of anomaly detection processing of the display apparatus according to the third embodiment, the anomaly detection processing being different from that in FIG. 15.

FIG. 13 is a diagram illustrating a configuration example of the anomaly detector in the display apparatus according to a third embodiment. FIGS. 14A to 14C are diagrams illustrating an example of the anomaly detection method of the display apparatus according to the third embodiment. FIG. 15 is a diagram illustrating an example of anomaly detection processing of the display apparatus according to the third embodiment. FIG. 16 is a diagram illustrating an example of anomaly detection processing of the display apparatus according to the third embodiment, the anomaly detection processing being different from that in FIG. 15. A schematic configuration of the display system to which the display apparatus according to the third embodiment is applied and a block configuration of the display apparatus according to the third embodiment are the same as those in the first embodiment described above, so that redundant description will not be repeated herein.

First, with reference to FIG. 13, the following describes a configuration of an anomaly detector 6*b* of the display apparatus according to the third embodiment.

In the example illustrated in FIG. 13, a first voltage threshold and a second voltage threshold larger than the first voltage threshold are set, in a determination reference voltage setting register 623*b* of a register unit 62*b*, as the source signal determination reference voltage VthS (gate signal determination voltage threshold VthG) for the response characteristic of each source drive signal S(X) (gate drive signal G(Y)) in an anomaly determination processor 61*b*. In the present embodiment, a "source signal first voltage threshold VthS1" and a "source signal second voltage threshold VthS2" are set as a source signal determination reference voltage for the response characteristic of each source drive signal S(X), and a "gate signal first voltage threshold VthG1" and a "gate signal second voltage threshold VthG2" are set as a gate signal determination voltage threshold for the response characteristic of each gate drive signal G(Y).

In a determination timing setting register 624*b* of the register unit 62*b*, an elapsed time threshold for measuring elapsed time from the predetermined time T0 is set as the source signal determination timing TthS (gate signal determination timing TthG) for the response characteristic of each source drive signal S(X) (gate drive signal G(Y)) in the anomaly determination processor 61*b*. In the present embodiment, the source signal determination timing TthS is referred to as a "source signal determination elapsed time threshold TthS" for the response characteristic of each source drive signal S(X), and the gate signal determination timing TthG is referred to as a "gate signal determination elapsed time threshold TthG" for the response characteristic of each gate drive signal G(Y).

Next, with reference to FIGS. 14A to 14C, the following describes the anomaly detection method of the display apparatus according to the third embodiment.

In the example illustrated in FIGS. 14A to 14C, a solid line indicates the response characteristic of the source drive signal S(X) (gate drive signal G(Y)) in a normal condition in which the source signal line (signal line) DTL (gate signal line (scanning line) SCL) is not broken or the element included in the display region 21 is not deteriorated. A dashed line indicates the response characteristic in a case in which, for example, the source signal line (signal line) DTL (gate signal line (scanning line) SCL) is broken due to damage in the display region 21 and the time constant of the source signal line equivalent circuit 211X (gate signal line equivalent circuit 211Y) is reduced due to a defect and the like in the electrostatic capacitance component C at a later stage than a broken part. Thus, the dashed line rises more steeply than the response characteristic in the normal condition. An alternate long and short dash line indicates the response characteristic in a case in which, for example, the element included in the display region 21 is deteriorated and the time constant of the source signal line equivalent circuit 211X (gate signal line equivalent circuit 211Y) is increased due to an increase and the like in the electrostatic capacitance component C. Thus, the alternate long and short dash line rises more gently than the response characteristic in the normal condition.

In the present embodiment, as described above, the source signal determination elapsed time threshold TthS for the response characteristic of each source drive signal S(X) and the gate signal determination elapsed time threshold TthG for the response characteristic of each gate drive signal G(Y) are set in the determination timing setting register 624*b* of the register unit 62*b*. As described above, in the determination reference voltage setting register 623*b* of the register unit 62*b*, the source signal first voltage threshold VthS1 and the source signal second voltage threshold VthS2 for the response characteristic of each source drive signal S(X) are set, and the gate signal first voltage threshold VthG1 and the gate signal second voltage threshold VthG2 for the response characteristic of each gate drive signal G(Y) are set.

In the example illustrated in FIG. 14A, regarding the response characteristic in the normal condition indicated by the solid line, a voltage VdS(X)1 of each source drive signal S(X) (a voltage VdG(Y)1 of the gate drive signal G(Y)) at time T1 is equal to or larger than the source signal first voltage threshold VthS1 (gate signal first voltage threshold VthG1) and equal to or smaller than the source signal second voltage threshold VthS2 (gate signal second voltage threshold VthG2). The time T1 is time when elapsed time TS(X) (elapsed time TG(Y)) from the predetermined time T0 reaches the source signal determination elapsed time threshold TthS (gate signal determination elapsed time threshold TthG). That is, FIG. 14A illustrates VthS1≤VdS(X)1≤VthS2, and VthG1≤VdG(Y)1≤VthG2. In this case, the anomaly detector 6*b* according to the present embodiment stores a value "0" as the source signal determination result DetS(X) (gate signal determination result DetG(Y)) in a determination result storage unit 625*b*.

In the example illustrated in FIG. 14B, regarding the response characteristic indicated by the dashed line rising more steeply than the response characteristic in the normal condition, a voltage VdS(X)2 of each source drive signal S(X) (a voltage VdG(X)2 of the gate drive signal G(X)) at the time T1 is larger than the source signal second voltage threshold VthS2 (gate signal second voltage threshold VthG2). As described above, the time T1 is time when the elapsed time TS(X) (elapsed time TG(Y)) from the predetermined time T0 reaches the source signal determination elapsed time threshold TthS (gate signal determination elapsed time threshold TthG). That is, FIG. 14B illustrates VthS2<VdS(X)2, and VthG2<VdG(Y)2. In this case, the anomaly detector 6*b* according to the present embodiment stores a value "1" (first anomaly determination result (second anomaly determination result)) as the source signal determination result DetS(X) (gate signal determination result DetG(Y)) in the determination result storage unit 625*b*.

In the example illustrated in FIG. 14C, regarding the response characteristic indicated by the alternate long and short dash line rising more gently than the response characteristic in the normal condition, a voltage VdS(X)3 of each source drive signal S(X) (a voltage VdG(X)3 of the gate drive signal G(X)) at the time T1 is smaller than the source signal first voltage threshold VthS1 (gate signal first voltage threshold VthG1). As described above, the time T1 is time when the elapsed time TS(X) (elapsed time TG(Y)) from the predetermined time T0 reaches the source signal determination elapsed time threshold TthS (gate signal determination elapsed time threshold TthG). That is, FIG. 14C illustrates VdS(X)3<VthS1, and VdG(Y)3<VthG1. In this case, the anomaly detector 6*b* according to the present embodiment stores a value "2" (first anomaly determination result (second anomaly determination result)) as the source signal determination result DetS(X) (gate signal determination result DetG(Y)) in the determination result storage unit 625*b*.

An anomaly processor 64*b* according to the present embodiment refers to the source signal determination result DetS(X) (gate signal determination result DetG(Y)) stored in the determination result storage unit 625*b*, and performs predetermined anomaly processing based on the determination result. As described above, in the present embodiment, the source signal determination result DetS(X) (gate signal determination result DetG(Y)) is stored in the determination result storage unit 625*b*, the value of the source signal determination result DetS(X) being different between a third case and a fourth case. The source signal determination result DetS(X) and the gate signal determination result DetG(Y) correspond to the first anomaly determination result and the second anomaly determination result, respectively. The third case is a case in which the voltage VdS(X)2 of each source drive signal S(X) (the voltage VdG(X)2 of the gate drive signal G(X)) at the time T1 is larger than the source signal second voltage threshold VthS2 (gate signal second voltage threshold VthG2). As described above, the time T1 is time when the elapsed time TS(X) (elapsed time TG(Y)) from the predetermined time T0 reaches the source signal determination elapsed time threshold TthS (gate signal determination elapsed time threshold TthG). The fourth case is a case in which the voltage VdS(X)3 of each source drive signal S(X) (the voltage VdG(X)3 of the gate drive signal G(X)) at the time T1 is smaller than the source signal first voltage threshold VthS1 (gate signal first voltage threshold VthG1). The anomaly processor 64*b* according to the present embodiment can therefore perform, for example, anomaly processing different between a case in which the source signal line (signal line) DTL (gate signal line (scanning line) SCL) is broken and the time constant of the source signal line equivalent circuit 211X (gate signal line equivalent circuit 211Y) is reduced, and a case in which the element included in the display region 21 is deteriorated and the time constant of the source signal line equivalent circuit 211X (gate signal line equivalent circuit 211Y) is increased due to an increase and the like in the electrostatic capacitance component C.

Next, with reference to FIG. 15, the following describes the anomaly detection method of the display apparatus according to the third embodiment.

When an event matching with the determination start condition set in the determination start condition setting register 622 occurs, anomaly detection operation processing is started (Step S401). At this point, the register unit 62*b* outputs the source signal for testing TSigS (gate signal for testing TSigG) set in the test pattern setting register 621, and outputs the source signal line anomaly detection operation start signal DecSWS (gate signal line anomaly detection operation start signal DecSWG) (Step S402). As with the first embodiment, the source signal for testing TSigS (gate signal for testing TSigG) according to the present embodiment is a voltage signal that rises to a predetermined level at the predetermined time T0. The source signal line anomaly detection operation start signal DecSWS (gate signal line anomaly detection operation start signal DecSWG) is output at the rise time T0 of the source signal for testing TSigS (gate signal for testing TSigG).

When detecting the source signal for testing TSigS (gate signal for testing TSigG), the anomaly determination processor 61*b* starts to perform anomaly determination processing on each source drive signal S(X) (gate drive signal G(Y)) (Step S403). More specifically, the anomaly determination processor 61*b* starts to observe each source drive signal S(X) (gate drive signal G(Y)), and starts to count elapsed time from the time T0 at which the source signal for testing TSigS (gate signal for testing TSigG) is detected.

The anomaly determination processor 61*b* compares the elapsed time TS(X) (elapsed time TG(Y)) from the predetermined time T0 with the source signal determination elapsed time threshold TthS (gate signal determination elapsed time threshold TthG) set in the determination timing setting register 624*b* of the register unit 62*b* (Step S404-1), and repeats the processing at Step S404-1 until when the elapsed time TS(X) (elapsed time TG(Y)) from the predetermined time T0 becomes equal to or larger than the source signal determination elapsed time threshold TthS (gate signal determination elapsed time threshold TthG) (No at Step S404-1).

If the elapsed time TS(X) (elapsed time TG(Y)) from the predetermined time T0 becomes equal to or larger than the source signal determination elapsed time threshold TthS (gate signal determination elapsed time threshold TthG) (Yes at Step S404-1), the anomaly determination processor 61*b* determines whether the voltage VdS(X) of each source drive signal S(X) (the voltage VdG(Y) of the gate drive signal G(Y)) at this point is larger than the source signal second voltage threshold VthS2 (gate signal second voltage threshold VthG2) (VthS2<VdS(X), VthG2<VdG(Y)) (Step S404-2).

If the voltage VdS(X) of each source drive signal S(X) (the voltage VdG(Y) of the gate drive signal G(Y)) is larger than the source signal second voltage threshold VthS2 (gate signal second voltage threshold VthG2) (Yes at Step S404-2), the anomaly determination processor 61*b* stores, in the determination result storage unit 625*b* of the register unit 62*b*, the source signal determination result DetS(X) (gate signal determination result DetG(Y)) indicating that the response characteristic of each source drive signal S(X) (gate drive signal G(Y)) rises more steeply than that in the normal condition (Step S405-1).

The anomaly processor 64*b* refers to the source signal determination result DetS(X) (gate signal determination result DetG(Y)) stored at Step S405-1, performs predetermined anomaly processing based on the determination result (Step S406-1), and ends the processing in this procedure.

If the voltage VdS(X) of each source drive signal S(X) (the voltage VdG(Y) of the gate drive signal G(Y)) is equal to or smaller than the source signal second voltage threshold VthS2 (gate signal second voltage threshold VthG2) (No at Step S404-2), the anomaly determination processor 61*b* determines whether the voltage VdS(X) of each source drive signal S(X) (the voltage VdG of the gate drive signal G(Y)) is smaller than the source signal first voltage threshold VthS1 (gate signal first voltage threshold VthG1) (VdS(X)<VthS1, VdG(Y)<VthG1) (Step S404-3).

If the voltage VdS(X) of each source drive signal S(X) (the voltage VdG of the gate drive signal G(Y)) is smaller than the source signal first voltage threshold VthS1 (gate signal first voltage threshold VthG1) (Yes at Step S404-3), the anomaly determination processor 61*b* stores, in the determination result storage unit 625*b* of the register unit 62*b*, the source signal determination result DetS(X) (gate signal determination result DetG(Y)) indicating that the response characteristic of each source drive signal S(X) (gate drive signal G(Y)) rises more gently than that in the normal condition (Step S405-2).

The anomaly processor 64*b* refers to the source signal determination result DetS(X) (gate signal determination result DetG(Y)) stored at Step S405-2, performs predetermined anomaly processing based on the determination result (Step S406-2), and ends the processing in this procedure.

If the voltage VdS(X) of each source drive signal S(X) (the voltage VdG(Y) of the gate drive signal G(Y)) is equal to or larger than the source signal first voltage threshold VthS1 (gate signal first voltage threshold VthG1) (No at Step S404-3), the anomaly determination processor 61*b* stores, in the determination result storage unit 625*b* of the register unit 62*b*, the source signal determination result DetS(X) (gate signal determination result DetG(Y)) indicating that the response characteristic of each source drive signal S(X) (gate drive signal G(Y)) is normal (Step S407). In this case, the anomaly processing is not performed by the anomaly processor 64*b*, the process proceeds to a normal operation of performing normal image display in the display region 21 (Step S408), and the processing in this procedure is ended. Thus, the process performed by the display apparatus 1 proceeds to the normal operation of performing normal image display in the display region 21.

Next, with reference to FIG. 16, the following describes anomaly detection processing different from that in the example illustrated in FIG. 15 performed by the display apparatus according to the third embodiment.

When an event matching with the determination start condition set in the determination start condition setting register 622 occurs, anomaly detection operation processing is started (Step S501). At this point, the register unit 62*b* outputs the source signal for testing TSigS (gate signal for testing TSigG) set in the test pattern setting register 621, and outputs the source signal line anomaly detection operation start signal DecSWS (gate signal line anomaly detection operation start signal DecSWG) (Step S502). As with the first embodiment, the source signal for testing TSigS (gate signal for testing TSigG) in the present embodiment is a voltage signal that rises to a predetermined level at the predetermined time T0. The source signal line anomaly detection operation start signal DecSWS (gate signal line anomaly detection operation start signal DecSWG) is output at the rise time T0 of the source signal for testing TSigS (gate signal for testing TSigG).

When detecting the source signal for testing TSigS (gate signal for testing TSigG), the anomaly determination processor 61*b* starts to perform anomaly determination processing on each source drive signal S(X) (gate drive signal G(Y)) (Step S503). More specifically, the anomaly determination processor 61*b* starts to observe each source drive signal S(X) (gate drive signal G(Y)), and starts to count elapsed time from the time T0 at which the source signal for testing TSigS (gate signal for testing TSigG) is detected.

The anomaly determination processor 61*b* compares the elapsed time TS(X) (elapsed time TG(Y)) from the predetermined time T0 with the source signal determination elapsed time threshold TthS (gate signal determination elapsed time threshold TthG) set in the determination timing setting register 624*b* of the register unit 62*b* (Step S504-1), and repeats the processing at Step S504-1 until when the elapsed time TS(X) (elapsed time TG(Y)) from the predetermined time T0 becomes equal to or larger than the source signal determination elapsed time threshold TthS (gate signal determination elapsed time threshold TthG) (No at step S504-1).

If the elapsed time TS(X) (elapsed time TG(Y)) from the predetermined time T0 becomes equal to or larger than the source signal determination elapsed time threshold TthS (gate signal determination elapsed time threshold TthG) (Yes at Step S504-1), the anomaly determination processor 61*b* determines whether the voltage VdS(X) of each source drive signal S(X) (the voltage VdG(Y) of the gate drive signal G(Y)) at this point is equal to or larger than the source signal first voltage threshold VthS1 (gate signal first voltage threshold VthG1) and equal to or smaller than the source signal second voltage threshold VthS2 (gate signal second voltage threshold VthG2) (VthS1 ≤VdS(X)≤VthS2, VthG1≤VdG(Y)≤VthG2) (Step S504-2).

If the voltage VdS(X) of each source drive signal S(X) (the voltage VdG(Y) of the gate drive signal G(Y)) is smaller than the source signal first voltage threshold VthS1 (gate signal first voltage threshold VthG1) or larger than the source signal second voltage threshold VthS2 (gate signal second voltage threshold VthG2) (No at Step S504-2), the anomaly determination processor 61*b* stores, in the determination result storage unit 625*b* of the register unit 62*b*, the source signal determination result DetS(X) (gate signal determination result DetG(Y)) indicating that the response characteristic of each source drive signal S(X) (gate drive signal G(Y)) is abnormal (Step S505).

The anomaly processor 64*b* refers to the source signal determination result DetS(X) (gate signal determination result DetG(Y)) stored at Step S505, performs predetermined anomaly processing based on the determination result (Step S506), and ends the processing in this procedure.

If the voltage VdS(X) of each source drive signal S(X) (the voltage VdG(Y) of the gate drive signal G(Y)) is equal to or larger than the source signal first voltage threshold VthS1 (gate signal first voltage threshold VthG1) and equal to or smaller than the source signal second voltage threshold VthS2 (gate signal second voltage threshold VthG2) (Yes at Step S504-2), the anomaly determination processor 61*b* stores, in the determination result storage unit 625*b* of the register unit 62*b*, the source signal determination result DetS(X) (gate signal determination result DetG(Y)) indicating that the response characteristic of each source drive signal S(X) (gate drive signal G(Y)) is normal (Step S507). In this case, the anomaly processing is not performed by the anomaly processor 64*b*, the process proceeds to a normal operation of performing normal image display in the display region 21 (Step S508), and the processing in this procedure is ended. Thus, the process performed by the display apparatus 1 proceeds to the normal operation of performing normal image display in the display region 21.

Through the anomaly detection processing illustrated in FIG. 16, it can be determined only whether the response characteristic of each source drive signal S(X) (gate drive signal G(Y)) is normal, and it cannot be detected whether the response characteristic of each source drive signal S(X) (gate drive signal G(Y)) rises more steeply than that in the normal condition or whether the response characteristic of each source drive signal S(X) (gate drive signal G(Y)) rises more gently than that in the normal condition. In the anomaly detection processing illustrated in FIG. 15, as described above with reference to FIGS. 14A to 14C, the source signal determination result DetS(X) (gate signal determination result DetG(Y)) of different values can be stored in the determination result storage unit 625*b*, the values being different between the case in which the response characteristic of each source drive signal S(X) (gate drive signal G(Y)) rises more steeply than that in the normal condition and the case in which the response characteristic of each source drive signal S(X) (gate drive signal G(Y)) rises more gently than that in the normal condition. The source signal determination result DetS(X) and the gate signal determination result DetG(Y) correspond to the first anomaly determination result and the second anomaly determination result, respectively. Accordingly, the anomaly processor 64*b* according to the present embodiment can perform, for example, anomaly processing different between the case in which the source signal line (signal line) DTL (gate signal line (scanning line) SCL) is broken and the time constant of the source signal line equivalent circuit 211X (gate signal line equivalent circuit 211Y) is reduced, and the case in which the element included in the display region 21 is deteriorated and the time constant of the source signal line equivalent circuit 211X (gate signal line equivalent circuit 211Y) is increased due to an increase and the like in the electrostatic capacitance component C.

As described above, in the anomaly detector 6*b* of the display apparatus 1 according to the third embodiment, the source signal determination elapsed time threshold TthS (gate signal determination elapsed time threshold TthG) for the response characteristic of each source drive signal S(X) (gate drive signal G(Y)) is set, and the source signal first voltage threshold VthS1 (gate signal first voltage threshold VthG1) for the response characteristic of each source drive signal S(X) (gate drive signal G(Y)) and the source signal second voltage threshold VthS2 (gate signal second voltage threshold VthG2) larger than the source signal first voltage threshold VthS1 (gate signal first voltage threshold VthG1) are set.

With this configuration, the anomaly detector 6*b* determines that the response characteristic of each source drive signal S(X) (gate drive signal G(Y)) is normal when the voltage VdS(X) of each source drive signal S(X) (the voltage VdG(Y) of the gate drive signal G(Y)) at time T2 is equal to or larger than the source signal first voltage threshold VthS1 (gate signal first voltage threshold VthG1) and equal to or smaller than the source signal second voltage threshold VthS2 (gate signal second voltage threshold VthG2). As described above, the time T2 is time when the elapsed time TS(X) (elapsed time TG(Y)) from the predetermined time T0 becomes equal to or larger than the source signal determination elapsed time threshold TthS (gate signal determination elapsed time threshold TthG). The anomaly detector 6*b* also determines that the response characteristic of each source drive signal S(X) (gate drive signal G(Y)) is abnormal when the voltage VdS(X) of each source drive signal S(X) (the voltage VdG(Y) of the gate drive signal G(Y)) at the time T2 is larger than the source signal second voltage threshold VthS2 (gate signal second voltage threshold VthG2) or smaller than the source signal first voltage threshold VthS1 (gate signal first voltage threshold VthG1).

Accordingly, the display apparatus 1 that can detect deterioration in the display region 21 can be implemented.

In the third case, the anomaly detector 6*b* can detect that the response characteristic of each source drive signal S(X) (gate drive signal G(Y)) rises more steeply than that in the normal condition. The third case is a case in which the voltage VdS(X) of each source drive signal S(X) (the voltage VdG(Y) of the gate drive signal G(Y)) at the time T2 is larger than the source signal second voltage threshold VthS2 (gate signal second voltage threshold VthG2). The time T2 is time when the elapsed time TS(X) (elapsed time TG(Y)) from the predetermined time T0 becomes equal to or larger than the source signal determination elapsed time threshold TthS (gate signal determination elapsed time threshold TthG). In the fourth case, the anomaly detector 6*b* can detect that the response characteristic of each source drive signal S(X) (gate drive signal G(Y)) rises more gently than that in the normal condition. The fourth case is a case when the voltage VdS(X) of each source drive signal S(X) (the voltage VdG(Y) of the gate drive signal G(Y)) at the time T2 is smaller than the source signal first voltage threshold VthS1 (gate signal first voltage threshold VthG1). Due to this, for example, the case in which the source signal line (signal line) DTL (gate signal line (scanning line) SCL) is broken and/or a short circuit occurs and the time constant of the source signal line equivalent circuit 211X (gate signal line equivalent circuit 211Y) is reduced can be separated from the case in which the element included in the display region 21 is deteriorated and the time constant of the source signal line equivalent circuit 211X (gate signal line equivalent circuit 211Y) is increased due to an increase and the like in the electrostatic capacitance component C, so that appropriate anomaly processing can be performed.

Fourth Embodiment

The present embodiment describes an example of a condition of transition to anomaly processing for the anomaly processor. A schematic configuration of the display system to which the display apparatus according to a fourth embodiment is applied, a block configuration of the display apparatus according to the fourth embodiment, and a configuration of the anomaly detector in the display apparatus according to the fourth embodiment are the same as those in the embodiments described above, so that the configuration of the display apparatus according to the first embodiment will be used herein without repeating redundant description.

Figure 17:
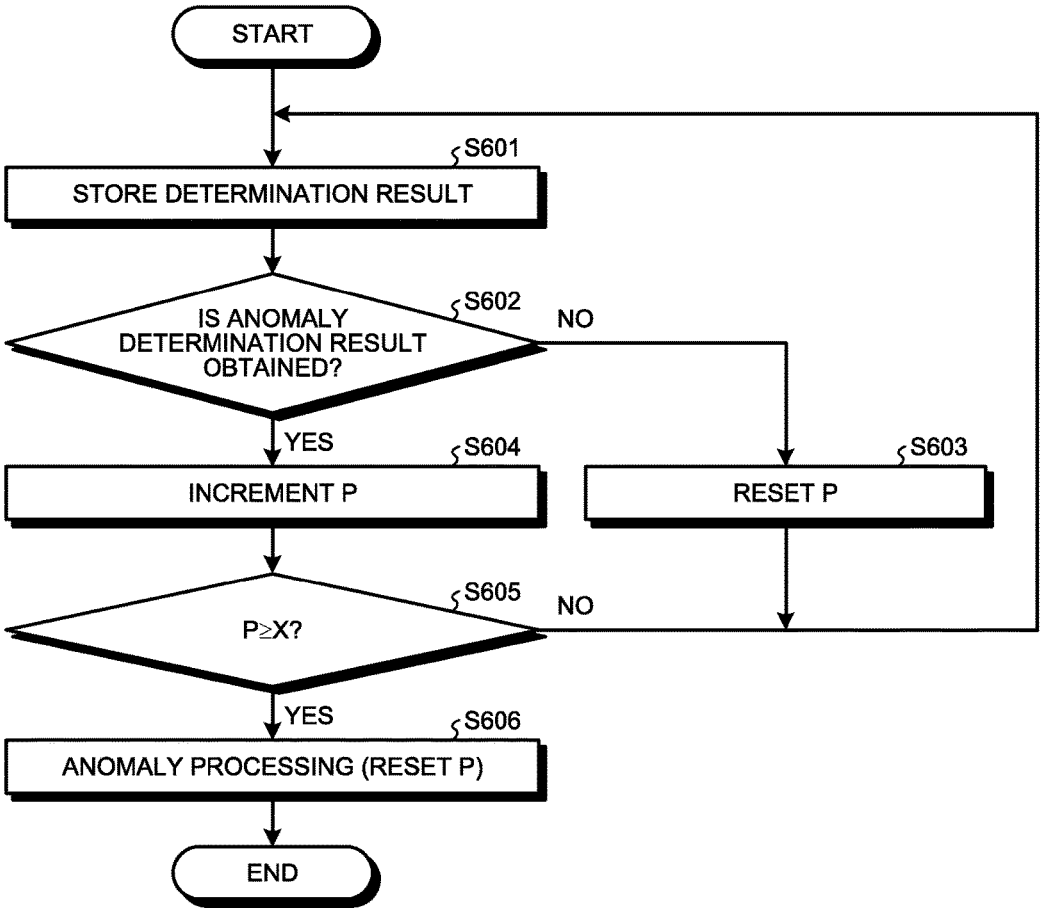
FIG. 17 is a diagram illustrating an example of transition processing to anomaly processing of an anomaly processor of a display apparatus according to a fourth embodiment.

FIG. 17 is a diagram illustrating an example of transition processing to anomaly processing of the anomaly processor of the display apparatus according to the fourth embodiment.

In the present embodiment, the anomaly processor 64 provides a threshold of a predetermined number X (X is, for example, a natural number equal to or larger than 1, X≥1) for the number P of times when the anomaly determination result is continuously stored in each source signal determination result DetS(X) and each gate signal determination result DetG(Y) of the determination result storage unit 625. Hereinafter, the number P is referred to as a continuous anomaly determination number P.

In the display apparatus 1 according to the present embodiment, when the continuous anomaly determination number P becomes equal to or larger than the predetermined number X (P≥X), the anomaly processor 64 determines that damage, deterioration, and the like occur in the display region 21 and performs predetermined anomaly processing. In other words, when the continuous anomaly determination number P is smaller than the predetermined number X (P<X), the anomaly processor 64 does not perform predetermined anomaly processing. Due to this, anomaly processing can be prevented from being performed in a case in which occurrence of sporadic and temporary damage, deterioration, and the like in the display region 21 is erroneously detected as anomaly due to a disturbance factor such as noise in the anomaly detection operation, for example, even when the display operation of the display apparatus 1 is normal.

The value of the predetermined number X according to the present embodiment may be set in advance in the register unit 62, or may be dynamically changed depending on an environmental factor in the display system 100 (for example, a temperature characteristic of a component included in the display system 100).

When the anomaly detection operation is started in the anomaly detector 6, and each source signal determination result DetS(X) and each gate signal determination result DetG(Y) are stored in the determination result storage unit 625 (Step S601), the anomaly processor 64 determines whether each source signal determination result DetS(X) and each gate signal determination result DetG(Y) stored in the determination result storage unit 625 are the anomaly determination results indicating that the response characteristic of each source drive signal S(X) (gate drive signal G(Y)) is abnormal (Step S602).

If each source signal determination result DetS(X) and each gate signal determination result DetG(Y) stored in the determination result storage unit 625 are not the anomaly determination results, that is, if the response characteristic of each source drive signal S(X) (gate drive signal G(Y)) is normal (No at Step S602), the anomaly processor 64 resets the continuous anomaly determination number P (Step S603), and the process returns to Step S601.

If each source signal determination result DetS(X) and each gate signal determination result DetG(Y) stored in the determination result storage unit 625 are the anomaly determination results (Yes at Step S602), the anomaly processor 64 increments the continuous anomaly determination number P ($P_{n+1}=P_n+1$) (Step S604), and determines whether the continuous anomaly determination number P is equal to or larger than the predetermined number X (P≥X) (Step S605).

If the continuous anomaly determination number P is smaller than the predetermined number X (P<X) (No at Step S605), the process returns to Step S601.

If the continuous anomaly determination number P becomes equal to or larger than the predetermined number X (P≥X) (Yes at Step S605), the anomaly processor 64 resets the continuous anomaly determination number P, performs predetermined anomaly processing (Step S606), and ends the processing in this procedure.

That is, in the present embodiment, if the response characteristic of each source drive signal S(X) (gate drive signal G(Y)) is detected to be normal before the continuous anomaly determination number P, which is the number of times when the anomaly determination result is continuously detected, becomes equal to or larger than the predetermined number X (P≥X), the process performed by the anomaly processor 64 does not proceed to the anomaly processing (Step S606).

Due to this, anomaly processing can be prevented from being performed in a case in which occurrence of sporadic and temporary damage, deterioration, and the like in the display region 21 is erroneously detected as anomaly due to a disturbance factor such as noise, for example, even when the display operation of the display apparatus 1 is normal, that is, the response characteristic of each source drive signal S(X) (gate drive signal G(Y)) is normal.

In the above example, the transition processing to anomaly processing according to the present embodiment is applied to the anomaly detector 6 in the configuration according to the first embodiment. Naturally, the transition processing to anomaly processing according to the present embodiment can also be applied to the anomaly detector 6*a* or 6*b* in the configuration according to the second embodiment or the third embodiment.

As described above, in the display apparatus 1 according to the fourth embodiment, the threshold of the predetermined number X is provided for the continuous anomaly determination number P, which is the number of times when the anomaly determination result is continuously stored in each source signal determination result DetS(X) and each gate signal determination result DetG(Y) of the determination result storage unit 625, and if the continuous anomaly determination number P becomes equal to or larger than the predetermined number X (P≥X), predetermined anomaly processing is performed. Due to this, anomaly processing can be prevented from being performed in a case in which occurrence of sporadic and temporary damage, deterioration, and the like in the display region 21 is erroneously detected as anomaly due to a disturbance factor such as noise, for example, even when the display operation of the display apparatus 1 is normal, that is, the response characteristic of each source drive signal S(X) (gate drive signal G(Y)) is normal.

Fifth Embodiment

The present embodiment describes an example of the condition of transition to anomaly processing for the anomaly processor different from that in the fourth embodiment. A schematic configuration of the display system to which the display apparatus according to a fifth embodiment is applied, a block configuration of the display apparatus according to the fifth embodiment, and a configuration of the anomaly detector in the display apparatus according to the fifth embodiment are the same as those in the embodiments described above, so that the configuration of the display apparatus according to the first embodiment will be used herein without repeating redundant description.

Figure 18:
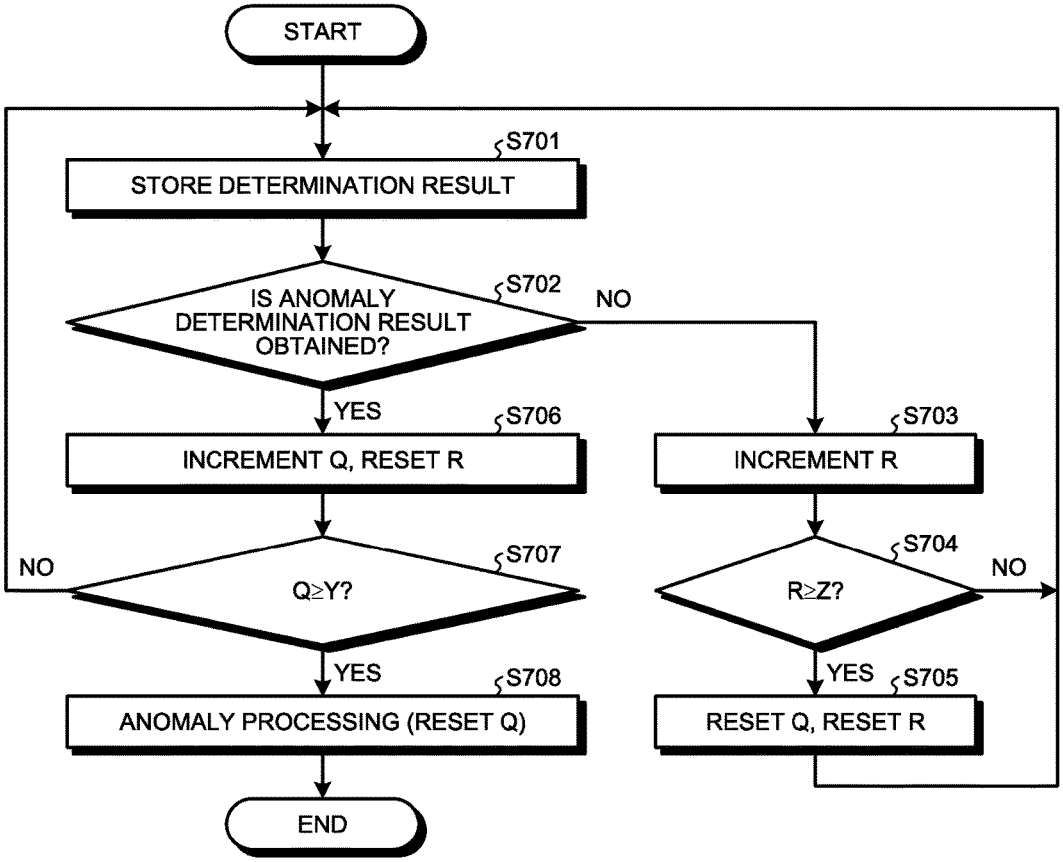
FIG. 18 is a diagram illustrating an example of transition processing to anomaly processing of an anomaly processor of a display apparatus according to a fifth embodiment.

FIG. 18 is a diagram illustrating an example of transition processing to anomaly processing of the anomaly processor of the display apparatus according to the fifth embodiment.

In the present embodiment, the anomaly processor 64 provides a threshold of a first predetermined number Y (Y is, for example, a natural number equal to or larger than 2, Y≥2) for the accumulated number Q of times when the anomaly determination result is stored in each source signal determination result DetS(X) and each gate signal determination result DetG(Y) of the determination result storage unit 625. Hereinafter, the accumulated number Q is referred to as an accumulated anomaly determination number Q.

In the present embodiment, the anomaly processor 64 provides a threshold of a second predetermined number Z (Z is, for example, a natural number equal to or larger than 2, Z≥2) for the number R of times when a normal determination result is continuously stored in the source signal determination result DetS(X) and the gate signal determination result DetG(Y) of the determination result storage unit 625. The normal determination result is a determination result indicating that the response characteristic of each source drive signal S(X) (gate drive signal G(Y)) is normal. Hereinafter, the number R is referred to as a continuous normal determination number R.

In the display apparatus 1 according to the present embodiment, if the accumulated anomaly determination number Q becomes equal to or larger than the first predetermined number Y (Q≥Y), the anomaly processor 64 determines that damage, deterioration, and the like occur in the display region 21 and performs predetermined anomaly processing. In other words, if the accumulated anomaly determination number Q is smaller than the first predetermined number Y (Q<Y) and the continuous normal determination number R becomes equal to or larger than the second predetermined number Z (R≥Z), the anomaly processor 64 does not perform predetermined anomaly processing. Accordingly, by appropriately setting the value of the first predetermined number Y for the accumulated anomaly determination number Q and the value of the second predetermined number Z for the continuous normal determination number R, occurrence of damage, deterioration, and the like in the display region 21 can be detected with higher accuracy, and unnecessary anomaly processing can be prevented from being performed.

The values of the first predetermined number Y and the second predetermined number Z in the present embodiment may be set in advance in the register unit 62, or may be dynamically changed depending on an environmental factor in the display system 100 (for example, a temperature characteristic of a component included in the display system 100).

When the anomaly detection operation is started in the anomaly detector 6 and each source signal determination result DetS(X) and each gate signal determination result DetG(Y) are stored in the determination result storage unit 625 (Step S701), the anomaly processor 64 determines whether each source signal determination result DetS(X) and each gate signal determination result DetG(Y) stored in the determination result storage unit 625 are anomaly determination results indicating that the response characteristic of each source drive signal S(X) (gate drive signal G(Y)) is abnormal (Step S702).

If each source signal determination result DetS(X) and each gate signal determination result DetG(Y) stored in the determination result storage unit 625 are not the anomaly determination results, that is, if the response characteristic of each source drive signal S(X) (gate drive signal G(Y)) is normal (No at Step S702), the anomaly processor 64 increments the continuous normal determination number R ($R_{n+1}=R_n+1$) (Step S703), and determines whether the continuous normal determination number R is equal to or larger than the second predetermined number Z (R≥Z) (Step S704).

If the continuous normal determination number R is smaller than the second predetermined number Z (R<Z) (No at Step S704), the process returns to Step S701.

If the continuous normal determination number R becomes equal to or larger than the second predetermined number Z (R≥Z) (Yes at Step S704), the anomaly processor 64 resets the accumulated anomaly determination number Q and the continuous normal determination number R (Q=0, R=0) (Step S705), and the process returns to Step S701.

If each source signal determination result DetS(X) and each gate signal determination result DetG(Y) stored in the determination result storage unit 25 are the anomaly determination results (Yes at Step S702), the anomaly processor 64 increments the accumulated anomaly determination number Q ($Q_{n+1}=Q_n+1$), resets the continuous normal determination number R (Step S706), and determines whether the accumulated anomaly determination number Q is equal to or larger than the first predetermined number Y (Q≥Y) (Step S707).

If the accumulated anomaly determination number Q is smaller than the first predetermined number Y (Q<Y) (No at Step S707), the process returns to Step S701.

If the accumulated anomaly determination number Q becomes equal to or larger than the first predetermined number Y (Q≥Y) (Yes at Step S707), the anomaly processor 64 resets the accumulated anomaly determination number Q, performs predetermined anomaly processing (Step S708), and ends the processing in this procedure.

That is, in the present embodiment, if the response characteristic of each source drive signal S(X) (gate drive signal G(Y)) is detected to be normal before the accumulated anomaly determination number Q, which is the accumulated number of times when the anomaly determination result is stored in each source signal determination result DetS(X) and each gate signal determination result DetG(Y) of the determination result storage unit 625, reaches the first predetermined number Y (Y is a natural number equal to or larger than 2, Y≥2), the anomaly processor 64 does not proceed to the anomaly processing (Step S708).

Accordingly, by appropriately setting the value of the first predetermined number Y for the accumulated anomaly determination number Q and the value of the second predetermined number Z for the continuous normal determination number R, occurrence of damage, deterioration, and the like in the display region 21 can be detected with higher accuracy, and unnecessary anomaly processing can be prevented from being performed.

In the above example, the transition processing to anomaly processing according to the present embodiment is applied to the anomaly detector 6 in the configuration according to the first embodiment. Naturally, the transition processing to anomaly processing according to the present embodiment can also be applied to the anomaly detector 6*a* or 6*b* in the configuration according to the second embodiment or the third embodiment.

As described above, in the display apparatus 1 according to the fifth embodiment, the threshold of the first predetermined number Y is provided for the accumulated anomaly determination number Q, which is the accumulated number of times when the anomaly determination result is stored in each source signal determination result DetS(X) and each gate signal determination result DetG(Y) of the determination result storage unit 625. If the accumulated anomaly determination number Q becomes equal to or larger than the first predetermined number Y (Q≥Y), predetermined anomaly processing is performed. Additionally, the threshold of the second predetermined number Z is provided for the continuous normal determination number R, which is the number of times when the determination result indicating that the response characteristic of each source drive signal S(X) (gate drive signal G(Y)) is normal is continuously stored in each source signal determination result DetS(X) and each gate signal determination result DetG(Y) of the determination result storage unit 625. If the accumulated anomaly determination number Q is smaller than the first predetermined number Y (Q<Y) and the continuous normal determination number R becomes equal to or larger than the second predetermined number Z (R≥Z), anomaly processing is not performed. Accordingly, by appropriately setting the value of the first predetermined number Y for the accumulated anomaly determination number Q and the value of the second predetermined number Z for the continuous normal determination number R, anomaly in the display operation performed by the liquid crystal display apparatus 1 can be detected with higher accuracy, and unnecessary anomaly processing can be prevented from being performed.

In the above embodiments, each of the determination result storage units 625, 625*a*, and 625*b*, or each of the register units 62, 62*a*, and 62*b* including the respective determination result storage units 625, 625*a*, and 625*b* is preferably a nonvolatile memory. Thus, even when the display system 100, the display apparatus 1, or the driver IC 3 including the anomaly detectors 6, 6*a*, or 6*b* is shut down due to the anomaly detection operation described above, for example, and electric power supply to the anomaly detectors 6, 6*a*, or 6*b* is temporarily stopped, the source signal determination results DetS(X) and the gate signal determination results DetG(Y) stored in the determination result storage units 625, 625*a*, or 625*b* are held, so that they can be used for analyzing a failure caused by damage, deterioration, and the like in the display region 21.

Naturally, the display apparatus 1 according to the embodiments described above can be applied not only as an on-vehicle display apparatus but also as a display apparatus for a smartphone and the like, for example.

In the above embodiments, the source driver 22 includes the source signal selector switch 223X, the gate driver 23 includes the gate signal selector switch 233Y, and the anomaly detection operation for detecting breaks in wires, deterioration, and the like in the display region 21 is performed by switching the signal to the source signal for testing or the gate signal for testing at the time of activation of the display system 100 or in the non-display period such as the vertical blanking period (vertical retrace period) in the display apparatus 1. Alternatively, breaks in wires, deterioration, and the like in the display region 21 can be detected by monitoring the usual gate signal or source signal during a display period without the source signal selector switch 223X and the gate signal selector switch 233Y.

The above embodiments describe an example in which the source signal output resistor 222X and the gate signal output resistor 232Y have about several kΩ. However, the source signal output resistor 222X and the gate signal output resistor 232Y are not limited thereto. The resistance component R of each source signal line (signal line) DTL and each gate signal line (scanning line) SCL is exemplified to be about several Ω, but the embodiment is not limited thereto.

The above embodiments describe the anomaly detection operation in a case in which the source signal line (signal line) DTL or/and the gate signal line (scanning line) SCL is/are broken or the element included in the display region 21 is deteriorated due to damage in the display region 21. Also in a case in which the source signal line (signal line) DTL or/and the gate signal line (scanning line) SCL is/are short-circuited due to damage in the display region 21, the response characteristic of the source drive signal S(X) or/and the gate drive signal G(Y) is/are different from the response characteristic in the normal condition. Accordingly, with the configuration according to the first embodiment described above, anomaly can be detected in a case in which the source signal line (signal line) DTL or/and the gate signal line (scanning line) SCL is/are short-circuited due to damage in the display region 21 by appropriately setting various determination conditions including the source signal determination reference voltage VthS, the gate signal determination voltage threshold VthG, the source signal determination timing TthS, and the gate signal determination timing TthG. With the configuration according to the second embodiment described above, anomaly can be detected in a case in which the source signal line (signal line) DTL or/and the gate signal line (scanning line) SCL is/are short-circuited due to damage in the display region 21 by appropriately setting various determination conditions including the source signal determination voltage threshold VthS, the gate signal determination voltage threshold VthG, the source signal first elapsed time threshold TthS1, and the source signal second elapsed time threshold TthS2. In a case in which the source signal line (signal line) DTL or/and the gate signal line (scanning line) SCL is/are short-circuited due to damage in the display region 21, anomaly processing can be performed, the anomaly processing being different from that in a case in which the source signal line (signal line) DTL (gate signal line (scanning line) SCL) is broken or the element included in the display region 21 is deteriorated due to damage in the display region 21.

The embodiments have been described above, but the present invention is not limited thereto. The components according to the present invention described above include a component that is easily conceivable by those skilled in the art, substantially the same component, and what is called an equivalent. The components described above can also be appropriately combined with each other. In addition, the components can be variously omitted, replaced, and modified without departing from the gist of the present invention.

What is claimed is:

1. A display apparatus comprising:

a signal line or a scanning line coupled to a plurality of pixels arranged in a display region;

a driver that supplies a drive signal via a resistor to the signal line or the scanning line; and an anomaly detector that monitors a response characteristic of a node between the resistor and the signal line or a node between the resistor and the scanning line, wherein the anomaly detector performs anomaly detection operation in the display region based on a change in a response characteristic of the drive signal generated in the node between the resistor and the signal line or the node between the resistor and the scanning line, outputs a predetermined test pattern to the driver, and performs the anomaly detection operation based on a determination reference voltage and a determination timing that are set in advance for the drive signal output from the driver in accordance with the test pattern.

2. The display apparatus according to claim 1, wherein the anomaly detector detects that anomaly has occurred in the display region when the response characteristic of the drive signal is out of a predetermined range.

3. The display apparatus according to claim 1, wherein the test pattern is a signal having a stepped waveform that is changed from a first potential to a second potential at predetermined time.

4. The display apparatus according to claim 3, wherein, in the anomaly detector, a voltage threshold is set as the determination reference voltage, and a predetermine period in which a voltage value of the drive signal reaches the voltage threshold is set as the determination timing for performing normal determination in the anomaly detection operation.

5. The display apparatus according to claim 3, wherein, in the anomaly detector, elapsed time from the predetermined time is set as the determination timing, and a voltage range of the drive signal when the elapsed time passes from the predetermined time is set as the determination reference voltage for performing normal determination in the anomaly detection operation.

6. The display apparatus according to claim 1, wherein the anomaly detector comprises a determination result storage unit that stores an anomaly determination result obtained in the anomaly detection operation.

7. The display apparatus according to claim 6, wherein the anomaly detector comprises an anomaly processor that performs predetermined anomaly processing based on the anomaly determination result stored in the determination result storage unit.

8. The display apparatus according to claim 7, wherein the anomaly processor performs the anomaly processing when the number of times when the anomaly determination result obtained in the anomaly detection operation is continuously stored in the determination result storage unit reaches a predetermined number.

9. The display apparatus according to claim 7, wherein, when the accumulated number of times when the anomaly determination result obtained in the anomaly detection operation is stored in the determination result storage unit reaches a first predetermined number, the anomaly processor performs the anomaly processing.

10. The display apparatus according to claim 9, wherein, when the number of times when the anomaly determination result obtained in the anomaly detection operation is continuously not stored in the determination result storage unit reaches a second predetermined number, the anomaly processor resets the first predetermined number and the second predetermined number.

11. The display apparatus according to claim 7, wherein the display apparatus comprises a plurality of the signal lines and a plurality of the scanning lines, the driver comprises:

a first driver that supplies a first drive signal via a resistor to each of the signal lines; and a second driver that supplies a second drive signal via a resistor to each of the scanning lines, the determination result storage unit stores individually a first anomaly determination result of a response characteristic of the first drive signal supplied to each of the signal lines, and stores individually a second anomaly determination result of a response characteristic of the second drive signal supplied to each of the scanning lines, and the anomaly processor performs the anomaly processing in accordance with a distribution status of anomaly occurrence spots in the display region obtained from each first anomaly determination result and each second anomaly determination result.

12. The display apparatus according to claim 6, wherein the determination result storage unit is a nonvolatile memory.

13. A display apparatus comprising:

a scanning line coupled to a plurality of pixels arranged in a display region;

a driver that supplies a drive signal via a resistor to the scanning line; and an anomaly detector that monitors a response characteristic of a node between the resistor and the scanning line, wherein the anomaly detector performs anomaly detection operation in the display region based on a change in a response characteristic of the drive signal generated in the node between the resistor and the scanning line, outputs a predetermined test pattern to the driver, and performs the anomaly detection operation based on a determination reference voltage and a determination timing that are set in advance for the drive signal output from the driver in accordance with the test pattern.

14. The display apparatus according to claim 13, wherein the anomaly detector detects that anomaly has occurred in the display region when the response characteristic of the drive signal is out of a predetermined range.

* * * * *